US012098044B2

(12) United States Patent
Baek et al.

(10) Patent No.: US 12,098,044 B2
(45) Date of Patent: Sep. 24, 2024

(54) FINISHER INCLUDING HEIGHT ADJUSTMENT UNIT

(71) Applicant: Hewlett-Packard Development Company, L.P., Spring, TX (US)

(72) Inventors: Taejin Baek, Seongnam-si (KR); Taehong Kim, Seongnam-si (KR); Wonic Tae, Seongnam-si (KR); Joonghyun Kim, Seongnam-si (KR); Jewon Jeong, Seongnam-si (KR); Wonkeun Lee, Seongnam-si (KR)

(73) Assignee: Hewlett-Packard Development Company, L.P., Spring, TX (US)

( * ) Notice: Subject to any disclaimer, the term of this patent is extended or adjusted under 35 U.S.C. 154(b) by 124 days.

(21) Appl. No.: 17/928,059

(22) PCT Filed: May 28, 2021

(86) PCT No.: PCT/US2021/034694
§ 371 (c)(1),
(2) Date: Nov. 28, 2022

(87) PCT Pub. No.: WO2021/243111
PCT Pub. Date: Dec. 2, 2021

(65) Prior Publication Data

US 2023/0211972 A1 Jul. 6, 2023

(30) Foreign Application Priority Data

May 29, 2020 (KR) ..... 10-2020-0064914

(51) Int. Cl.
*B65H 31/30* (2006.01)
*B65H 31/10* (2006.01)
(Continued)

(52) U.S. Cl.
CPC ..... *B65H 31/30* (2013.01); *B65H 31/10* (2013.01); *B65H 31/26* (2013.01); *B65H 31/32* (2013.01);
(Continued)

(58) Field of Classification Search
CPC ..... B65H 29/38; B65H 37/04; B65H 31/00; B65H 2405/353; G03G 21/16
(Continued)

(56) References Cited

U.S. PATENT DOCUMENTS 5,553,843 A * 9/1996 Schenk ..... B65H 29/00 271/226
5,649,695 A 7/1997 Lawrence
(Continued)

FOREIGN PATENT DOCUMENTS

JP 05-039823 A 2/1993
JP 2000-044111 A 2/2000
(Continued)

*Primary Examiner* — Leslie A Nicholson, III
(74) *Attorney, Agent, or Firm* — Brooks, Cameron & Huebsch, PLLC

(57) ABSTRACT

An example finisher includes a first portion extending in a vertical direction and including a height adjustment unit, a second portion extending from the first portion in a lateral direction and including a finishing unit to perform a finishing process, and a stacker to receive paper discharged from the finishing unit, the stacker extending in an opposite direction to the second portion in the lateral direction. The height adjustment unit is to adjust a height of the second portion from an installation surface and includes a base plate including a horizontal slot, a guide plate including an inclined slot, and a slide lever coupling the horizontal slot and the inclined slot.

15 Claims, 16 Drawing Sheets

(51) Int. Cl.

| | |
|---|---|
| ***B65H 31/26*** | (2006.01) |
| ***B65H 31/32*** | (2006.01) |
| ***B65H 37/04*** | (2006.01) |
| ***B65H 43/06*** | (2006.01) |

(52) U.S. Cl.
CPC ..... *B65H 37/04* (2013.01); *B65H 43/06* (2013.01); *B65H 2301/4213* (2013.01); *B65H 2403/41* (2013.01); *B65H 2408/121* (2013.01); *B65H 2511/15* (2013.01)

(58) Field of Classification Search
USPC ..... 270/58.13, 58.19, 58.28; 399/110
See application file for complete search history.

(56) References Cited

U.S. PATENT DOCUMENTS

| | | | | |
|---|---|---|---|---|
| 7,284,752 | B2 | 10/2007 | Nagata et al. | |
| 7,571,909 | B2 | 8/2009 | Saeki et al. | |
| 7,874,552 | B2 | 1/2011 | Iizuka | |
| 7,883,079 | B2 | 2/2011 | Sato et al. | |
| 7,971,875 | B2 | 7/2011 | Iino et al. | |
| 8,226,080 | B2 | 7/2012 | Morita et al. | |
| 8,408,531 | B2 | 4/2013 | Sato | |
| 8,424,962 | B2 | 4/2013 | Uehara et al. | |
| 8,672,312 | B2 | 3/2014 | Nonaka | |
| 8,840,111 | B2 * | 9/2014 | Shirasaki | B65H 31/00 271/294 |
| 8,955,838 | B2 | 2/2015 | Saito et al. | |
| 8,971,756 | B2 * | 3/2015 | Kawasumi | H04N 1/00562 399/110 |
| 9,186,926 | B2 | 11/2015 | Nonaka | |
| 9,381,760 | B2 | 7/2016 | Egawa et al. | |
| 10,496,031 | B2 | 12/2019 | Sugiyama | |
| 10,828,925 | B2 | 11/2020 | Kubo et al. | |
| 11,518,641 | B2 | 12/2022 | Takahashi et al. | |
| 2010/0068026 | A1 | 3/2010 | Brewer, III et al. | |
| 2011/0215517 | A1 | 9/2011 | Mizutani et al. | |

FOREIGN PATENT DOCUMENTS

| | | | |
|---|---|---|---|
| JP | 2003-175268 | A | 6/2003 |
| JP | 2004-126157 | A | 4/2004 |
| JP | 2006-206197 | A | 8/2006 |
| JP | 2014-118295 | A | 6/2014 |

* cited by examiner

FINISHER INCLUDING HEIGHT ADJUSTMENT UNIT

BACKGROUND

A finisher (i.e., a post-processing device) may perform a finishing process on a printing medium such as paper that is output by an image forming apparatus and may be connected to different image forming apparatuses to provide the finishing process. Because each image forming apparatus may have a unique docking height for connecting with the finisher, a height of the finisher may be adjustable.

BRIEF DESCRIPTION OF THE DRAWINGS

Various examples will be described below with reference to the following figures.

DETAILED DESCRIPTION

Figure 1:
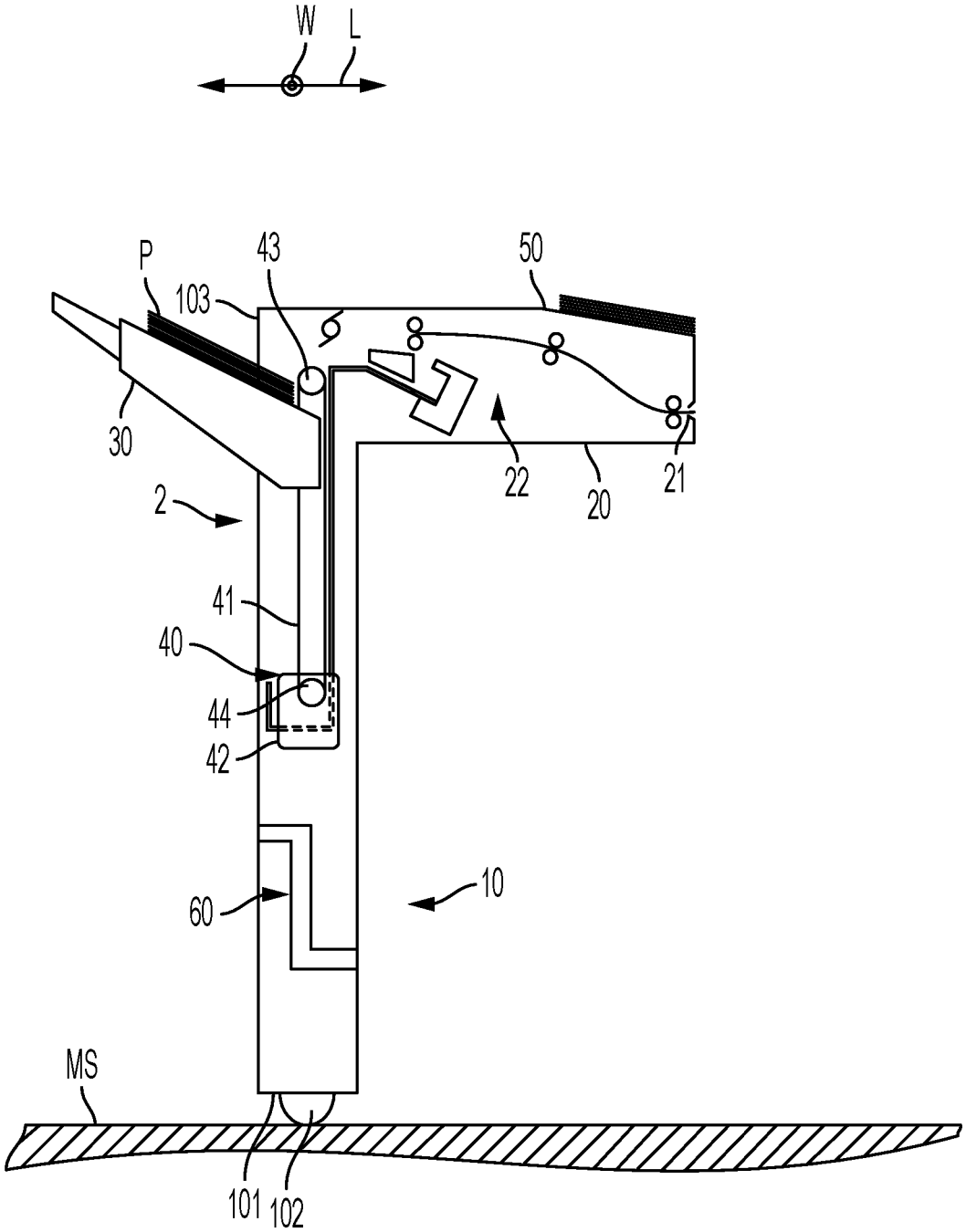
FIG. 1 is a schematic diagram of a finisher according to an example.

Hereinafter, various examples will be described with reference to the accompanying drawings. In the following description, components having substantially the same functional configuration will be omitted by repeating the same reference numerals. The feature elements are not always drawn to scale and sometimes, a portion thereof may be emphasized to illustrate operation, effect, etc. of an example of the present disclosure.

The term "image forming apparatus" as used herein may encompass any of a variety of apparatuses, such as printers, scanners, photocopiers, facsimile machines, multi-function printers (MFPs), display devices and so on, that carry out an image forming job. Moreover, an image forming apparatus may be a two-dimensional (2D) or three-dimensional (3D) image forming apparatus.

The term "image forming job" as used herein may encompass any of a variety of image-related jobs, such as a print job, a scan job, a photocopy job, a facsimile job, and the like, that involve an operation of forming an image and/or other processing operation, e.g., creation, generation and/or transfer of an image file. Furthermore, an image forming job performed by an image forming apparatus may comprise various jobs related to printing, photocopying, scanning, faxing, storing, transmitting, coating, etc.

The term "finisher" as used herein may encompass any of a variety of apparatuses that perform a finishing process such as a bookbinding process for binding multiple sheets of aligned paper, a folding process for folding a sheet of paper, a punching process for punching holes in a sheet of paper, a sorter to sort multiple sheets of paper, a collator to collate multiple sheets of paper, a postage machine to apply postage to a sheet of paper, or the like.

An image forming apparatus may perform an image forming job on a printing medium such as paper. The image forming apparatus may include a concave loading portion on which a discharged printing medium may be loaded and may include a paper discharge port located in the concave loading portion. A finisher may be selectively provided to perform a finishing process on a printing medium that is output from the image forming apparatus. Due to its size, the finisher may be located at a side of the image forming apparatus and may be removably connected (e.g., coupled, docked, combined, etc.) to the image forming apparatus.

The finisher may include a support structure that extends in a vertical direction and may include a finishing unit that extends in a lateral direction from the support structure. The finishing unit may be supported by the support structure at the outside of the image forming apparatus and may be located within the concave loading portion of the image forming apparatus as the finisher is connected to the image forming apparatus.

A finisher may include a stacker on which paper on which finishing has been completed may be loaded. The stacker may extend in an opposite direction to the finishing unit from the support structure and may be located outside the image forming apparatus. An elevation driving unit including a motor for elevating the stacker may be provided in the support structure. A second stacker, on which paper on which finishing is not performed may be loaded, of the paper discharged from the printing device may be provided in the finishing unit.

A finisher may be removably connected to different image forming apparatuses wherein each image forming apparatus may have a concave loading portion located at a height (e.g., a docking height) that is different from that of other image forming apparatuses. In that case, a length of the support structure extending in the vertical direction and supporting the finishing unit may be adjusted corresponding to a height of an image forming apparatus to which the finisher is to be connected. Thus, a finisher that may be applied to different image forming apparatuses having various heights may be implemented.

Different mechanisms may be provided to adjust the height of a finishing unit. For example, a support structure of a finisher may be coupled to a removable height adjustment member. In that case, a height adjustment member having a certain length may be coupled to the support structure such that the height of the finishing unit corresponds to the height of the concave loading portion of an image forming apparatus. However, because each image forming apparatus may have a unique height corresponding to its concave loading portion, a plurality of height adjustment members having different lengths may be needed.

According to an example, a finisher may include a support structure extending in the vertical direction and may include a finishing unit extending from the support structure in the lateral direction. The support structure may include a height adjustment unit to adjust a height of the finishing unit from an installation surface such that a height of the finishing unit corresponds to a height (e.g., a docking height) of a concave loading portion of an image forming apparatus to which the finisher is to be connected. Thus, adjusting the height of the finishing unit is convenient for a user.

Hereinafter, various examples of a finisher will be described with reference to the drawings. Components having the same function are denoted by the same reference numerals, and a redundant description thereof will be omitted.

Figure 2:
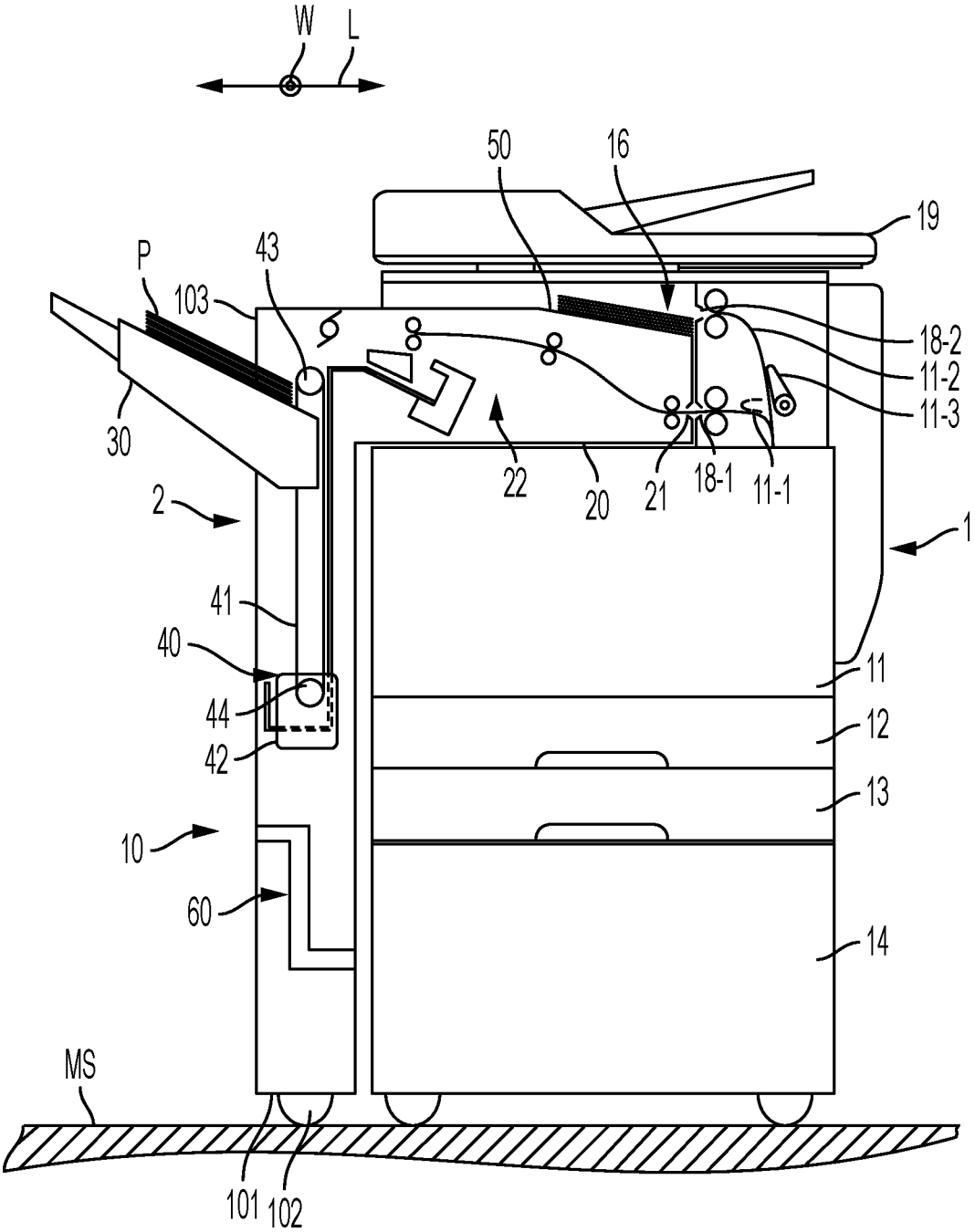
FIG. 2 is a schematic diagram of a finisher connected to an image forming apparatus according to an example.
Figure 3:
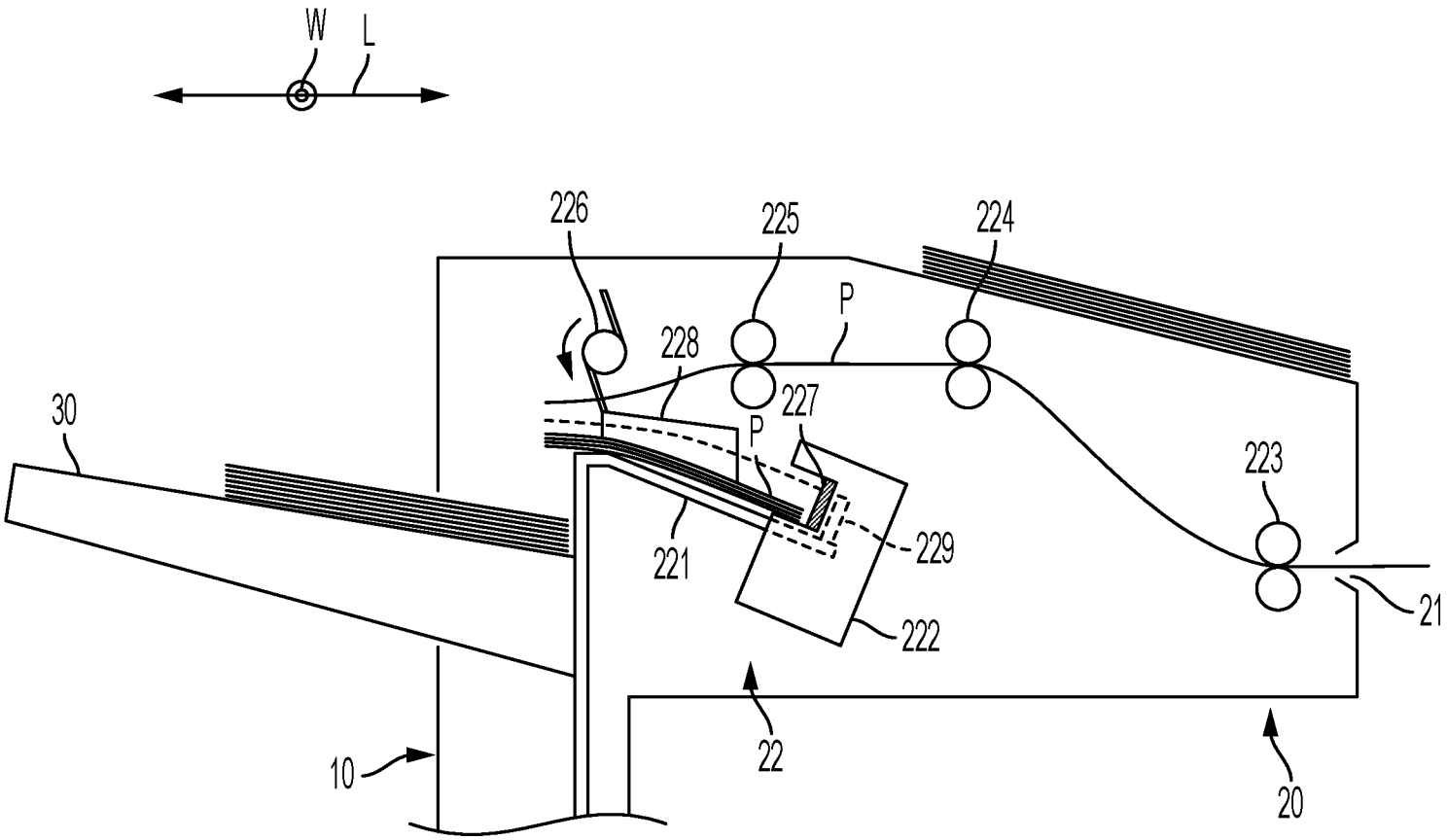
FIG. 3 is a schematic diagram of a finishing unit shown in FIGS. 1 and 2 according to an example.

FIG. 1 is a schematic diagram of a finisher according to an example. FIG. 2 is a schematic diagram of a finisher connected to an image forming apparatus according to an example. FIG. 3 is a schematic diagram of a finishing unit shown in FIGS. 1 and 2 according to an example.

Referring to FIGS. 1, 2, and 3, a finisher 2 may include a first portion 10 extending in a vertical direction and including a height adjustment unit 60. The finisher 2 may include a second portion 20 that includes an entrance 21 into which a printing medium (e.g., paper) P that is a finishing process target may be inserted, a finishing unit 22 for performing a finishing process on the paper P and that extends from the first portion 10 in a lateral direction, a stacker 30 on which paper P discharged from the finishing unit 22 may be loaded and which extends in an opposite direction to the second portion 20 based on the first portion 10, and an elevation driving unit 40 that is provided in the second portion 20 to elevate the stacker 30 in the vertical direction.

The first portion 10 may extend in the vertical direction. The vertical direction may be a direction relative to a force of gravity. The vertical direction may be a stacking direction in which paper P may be discharged from the finishing unit 22 and loaded on the stacker 30. As shown in FIG. 2, as the finisher 2 is connected to an image forming apparatus 1, the first portion 10 is located outside the image forming apparatus 1. In an example, the first portion 10 may be located on a side of the image forming apparatus 1 in the lateral direction. The lateral direction may be a conveying direction of the paper P discharged from the finishing unit 22 into the stacker 30. That is, the lateral direction may be a length direction L of the paper P passing through the finishing unit 22. A bottom end 101 of the first portion 10 may be spaced apart from an installation surface MS on which the finisher 2 and the image forming apparatus 1 are located. In this case, a support unit 102 supported at the installation surface MS may be provided on the bottom end 101 of the first portion 10. The support unit 102 may have various shapes, such as a foot, a roller, a caster, and the like.

The second portion 20 may extend from the first portion 10 in the lateral direction. In an example, the second portion 20 may extend from a top end 103 of the first portion 10 in the lateral direction. The second portion 20 may include the finishing unit 22 that performs a finishing process on the paper P. In the illustrated example, the finishing unit 22 may perform a bookbinding process for binding multiple sheets of aligned paper P.

Referring to FIG. 3, the finishing unit 22 may include a paper alignment tray 221 on which a plurality of sheets of paper P, which are a finishing process target, may be aligned. The finishing unit 22 may also include a binder 222 to put a binding needle (e.g., staple) on the edge of the plurality of sheets of paper P. The binder 222 may be aligned with one edge of a distal end of the paper alignment tray 221 and may put the binding needle on the edge of the plurality of sheets of paper P.

A conveying structure for conveying the papers P may be disposed in the finishing unit 22. In an example, the conveying structure may include conveying rollers 223, 224, and 225, and an alignment member 226. Each of the conveying rollers 223, 224, and 225 may include a pair of rollers rotating while being engaged with each other and may convey the papers P inserted through the entrance 21. The alignment member 226 may be located above the paper alignment tray 221. The alignment member 226 may include a paddle having an elastic arm, for example. The paper P conveyed by the conveying rollers 223, 224, and 225 may be dropped into the paper alignment tray 221. The alignment member 226 may push the paper P on the paper alignment tray 221 toward an end guide 227 while being rotated. An end of the length direction L of the plurality of loaded sheets of paper P may be aligned by the end guide 227 on the paper alignment tray 221. The plurality of sheets of paper P loaded on the paper alignment tray 221 may be aligned by a pair of side guides 228 in a width direction W. Through this configuration, the plurality of sheets of paper P may be aligned on the paper alignment tray 221.

The binder 222 may put the binding needle on the edge of the plurality of sheets of paper P aligned on the paper alignment tray 221. The binder 222 may put the binding needle in a position of the edge while being moved in the width direction W along the edge of the length direction L of the plurality of sheets of paper P aligned on the paper alignment tray 221. The plurality of sheets of paper P, of which a bookbinding process has been completed, may be pushed by an ejector 229 moved in the length direction L and may be discharged into the stacker 30.

The stacker 30 may extend toward an opposite side of the second portion 20 in the lateral direction based on the first portion 10. The stacker 30 may be elevated in the vertical direction to increase a stacking capacity. The stacker 30 may be supported by the first portion 10 to be elevated in the vertical direction. The elevation driving unit 40 may elevate the stacker 30. The elevation driving unit 40 may be provided in the first portion 10. The elevation driving unit 40 may be implemented in various forms. The elevation driving unit 40 may include, for example, a flexible circulating member 41 such as a flat belt, a timing belt, or a wire, which is supported by the first portion 10 to be able to circulate in the vertical direction, and a driving motor 42 for driving the circulating member 41. For example, the circulating member 41 may be supported by a pair of pulleys 43 and 44 that are spaced apart from each other in the vertical direction, and the driving motor 42 may rotate one of the pair of pulleys 43 and 44. The stacker 30 may be connected to the circulating member 41. Through this configuration, a control unit (e.g., a control unit 80, FIG. 15) may drive the driving motor 42 according to the number of sheets of paper P loaded on the stacker 30 to elevate the stacker 30 in the vertical direction to a suitable position.

The stacking capacity of the stacker 30 depends on the weight of the stacker 30 including the loaded paper P. The driving motor 42 may be sized to drive the weight of the stacker 30 and the weight of the maximum number of sheets of paper P that may be loaded. In the finisher 2 according to an example, the elevation driving unit 40 for elevating the stacker 30 may be installed in the first portion 10. Thus, the driving motor 42 may have a torque that is sufficient to drive the weight of the stacker 30 and the weight of the paper P loaded thereon. Thus, it is easy to increase the stacking capacity of the stacker 30 and the finisher 2, in which the elevation driving unit 40 is provided in the first portion 10, is suitable for large-capacity.

The image forming apparatus 1 may include a printing unit 11 that prints an image on a print medium, for example, paper P. The finisher 2 may perform a finishing process on the paper P discharged from the printing unit 11. The printing unit 11 may print an image on the paper P by using various printing methods, such as an electrophotographic method, an inkjet method, a thermal transfer method, a heat sublimation method, or the like. The paper P may be supplied to the printing unit 11 from a paper feeding unit. The paper feeding unit may include cassette feeders located under the printing unit 11, for example, at least one of a main cassette feeder 12, a secondary cassette feeder 13, and a high-capacity feeder 14. The paper feeding unit may also include a multi-purpose paper feeding tray (not shown).

The image forming apparatus 1 may further include a scanner unit 19 to read an image recorded on a document. The scanner unit 19 may be located on the printing unit 11. The scanner unit 19 may have various structures, such as a flatbed structure, whereby an image is read while the document is located at a fixed position and a reading member is moved, a document feed method, whereby the reading member is located at the fixed position and the document is conveyed, and a composite method thereof.

The image forming apparatus 1 may include a concave loading portion 16. In an example, the concave loading portion 16 may be provided between the printing unit 11 and the scanner unit 19. The paper P discharged from the printing unit 11 may be discharged into the concave loading portion 16. The paper P may be discharged from one side of the lateral direction of the concave loading portion 16 toward the other side. The other side of the lateral direction of the concave loading portion 16 may be open. The front of the concave loading portion 16 may also be open. The rear of the concave loading portion 16 may also be open. A user may access the paper P through the other side or the front of the concave loading portion 16.

The finisher 2 may be connected to and detached from the image forming apparatus 1. In a finisher 2 according to an example, the second portion 20 including the finishing unit 22 may extend from the first portion 10 in the lateral direction. The finisher 2 may have a structure in which the second portion 20 including the finishing unit 22 is mounted between the printing unit 11 and the scanner unit 19 of the image forming apparatus 1. The first portion 10 may be located on the side of the image forming apparatus 1 in the lateral direction. Referring to FIGS. 1 and 2, as the finisher 2 is connected to the image forming apparatus 1, the second portion 20 that extends from the first portion 10 in the lateral direction may be inserted into the concave loading portion 16. Although not shown, a first mounting portion may be provided in the second portion 20, and a second mounting portion on which the first mounting portion may be seated, may be provided in the concave loading portion 16 of the image forming apparatus 1. The first mounting portion and the second mounting portion may be implemented by, for example, a first rail and a second rail, which extend in the lateral direction and have complementary shapes. A locking device to lock the finisher 2 in a mounting position may be provided on the second rail. After the first rail is fitted to the second rail, the finisher 2 may be pushed in the lateral direction and located in the mounting position so that the finisher 2 may be mounted in the image forming apparatus 1. In the example of FIG. 1, the weight of the finisher 2 may be supported by the second rail. The finishing unit 22 may be located in the concave loading portion 16, and the entrance 21 may be aligned with a paper discharge port (e.g., a first paper discharge portion 18-1) of the image forming apparatus 1. The paper P discharged from the printing unit 11 may be directly supplied to the finishing unit 22. The locking device may be released, and the finisher 2 may be moved in the lateral direction and separated from the image forming apparatus 1.

The second portion 20 may include a second stacker 50 on which the paper P of which finishing is not performed, is stacked. Referring to FIGS. 1 through 3, the second stacker 50 may be provided above the entrance 21. The top surface of the second portion 20 may function as the second stacker 50. The image forming apparatus 1 may have a first path 11-1 for a finishing process of the paper P discharged from the printing unit 11 and a second path 11-2 for discharging the paper P discharged from the printing unit 11. A path selection member 11-3 may selectively guide the paper P toward the first path 11-1 or the second path 11-2. The first path 11-1 may be connected to the first paper discharge portion 18-1 opposite to the entrance 21 of the finishing unit 22. Thus, the paper P discharged along the first path 11-1 may be discharged into the stacker 30 via the finishing unit 22. The second path 11-2 may be connected to a second paper discharge port 18-2. The paper P discharged into the second paper discharge port 18-2 may be directly discharged into the second stacker 50. The user may access the paper P loaded on the second stacker 50 via the other side or the front of the concave loading portion 16.

A height of the concave loading portion 16, into which the finishing unit 22 may be inserted, may vary. For example, a height from the installation surface MS to the concave loading portion 16 may vary according to a configuration of the printing unit 11 of the image forming apparatus 1. Also, the height from the installation surface MS to the concave loading portion 16 may vary according to the configuration of a paper feeding unit located under the printing unit 11. For example, one, two, or three of the main cassette feeder 12, the secondary cassette feeder 13, and the high-capacity feeder 14 may be installed under the printing unit 11. The height from the installation surface MS to the concave loading portion 16 may vary according to each combination.

In view of these different combinations, the finisher 2 may include the first portion 10 that extends in a vertical direction, the second portion 20 that includes the finishing unit 22 for performing a finishing process on the paper P and extends from the first portion 10 in a lateral direction, the stacker 30 on which the paper P discharged from the finishing unit 22 is loaded and which extends in an opposite direction to the second portion 20 based on the first portion 10, and the height adjustment unit 60 for adjusting the height from the installation surface MS of the second portion 20.

The height of the second portion 20 refers to the height from the installation surface MS on which the finisher 2 is located, to the second portion 20. Various examples of the height adjustment unit 60 that may be applied to the finisher 2 shown in FIGS. 1, 2, and 3, in which the bottom end 101 of the first portion 10 is spaced apart from the installation surface MS, will be described.

Figure 4:
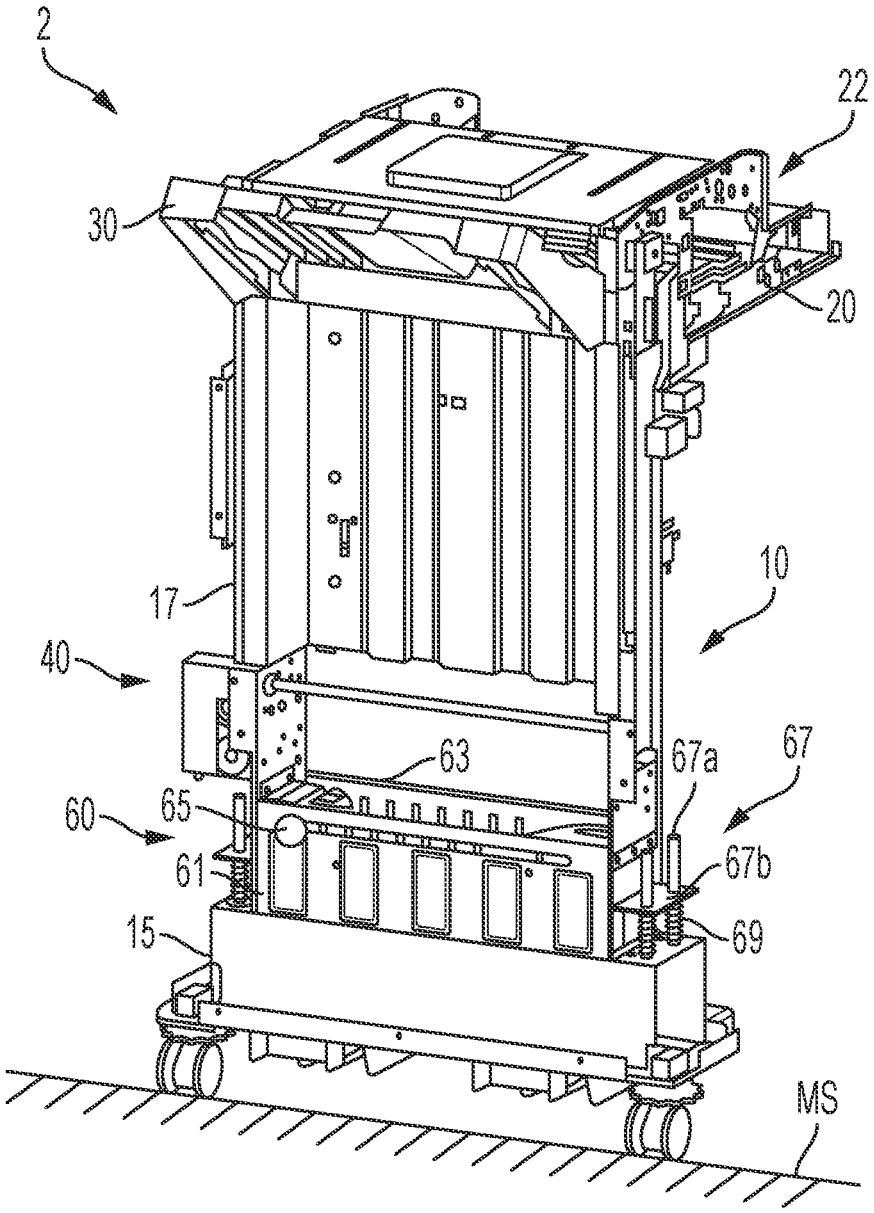
FIG. 4 is a schematic diagram of a finisher including a height adjustment unit according to an example.
Figure 5:
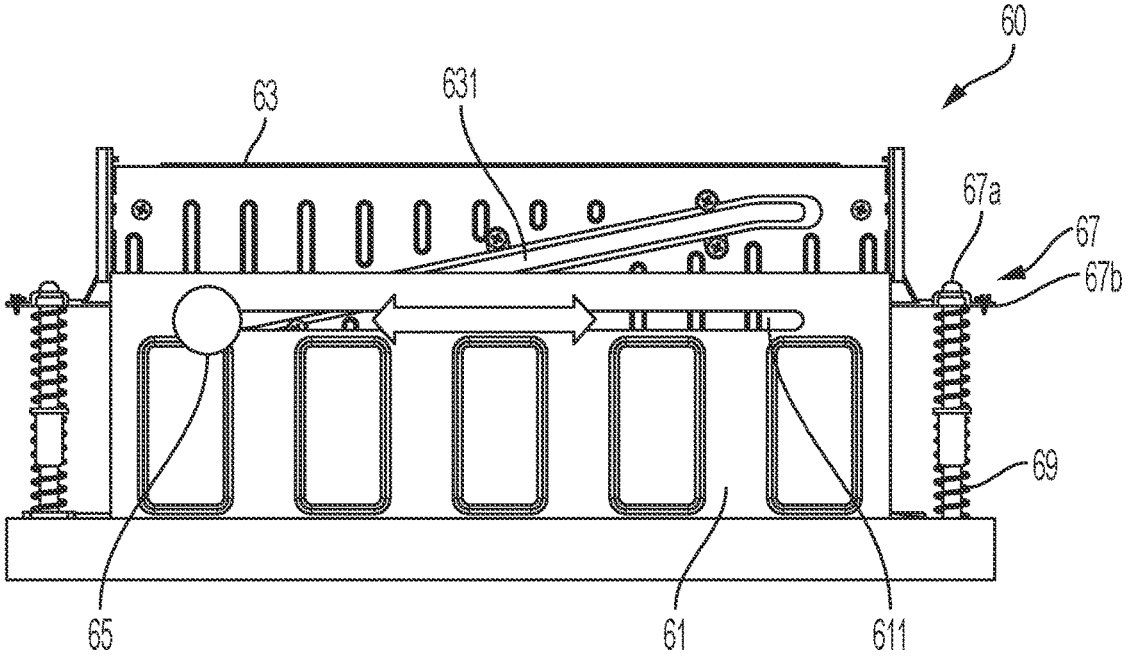
FIG. 5 is a schematic diagram of a height adjustment unit according to an example.
Figure 6:
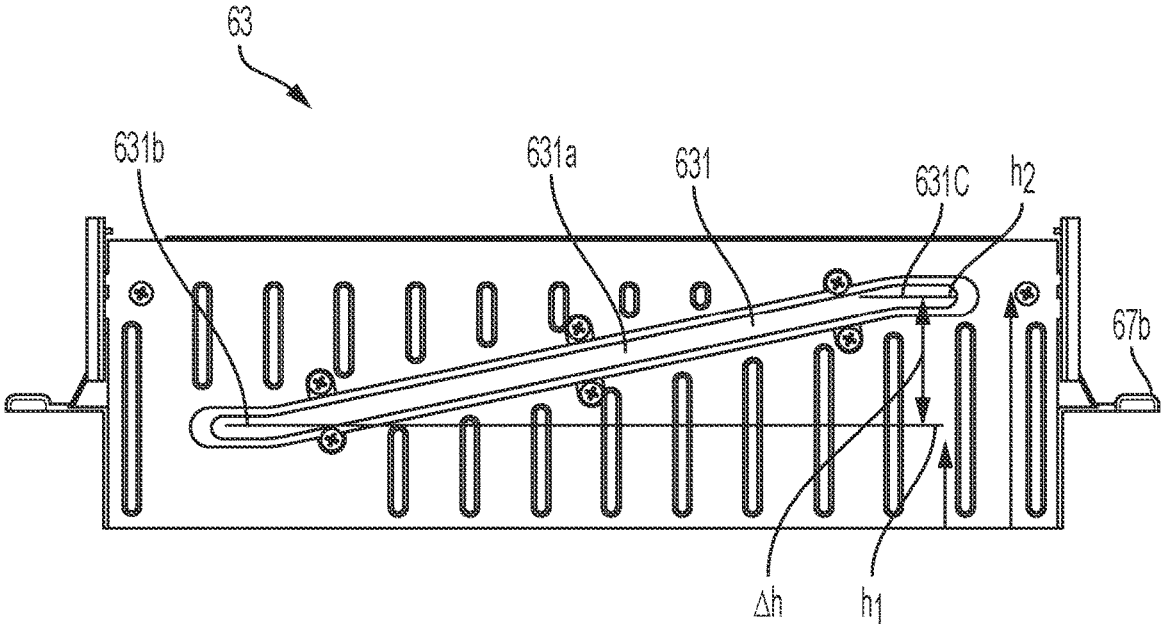
FIG. 6 is a schematic diagram of a guide plate according to an example.
Figure 7:
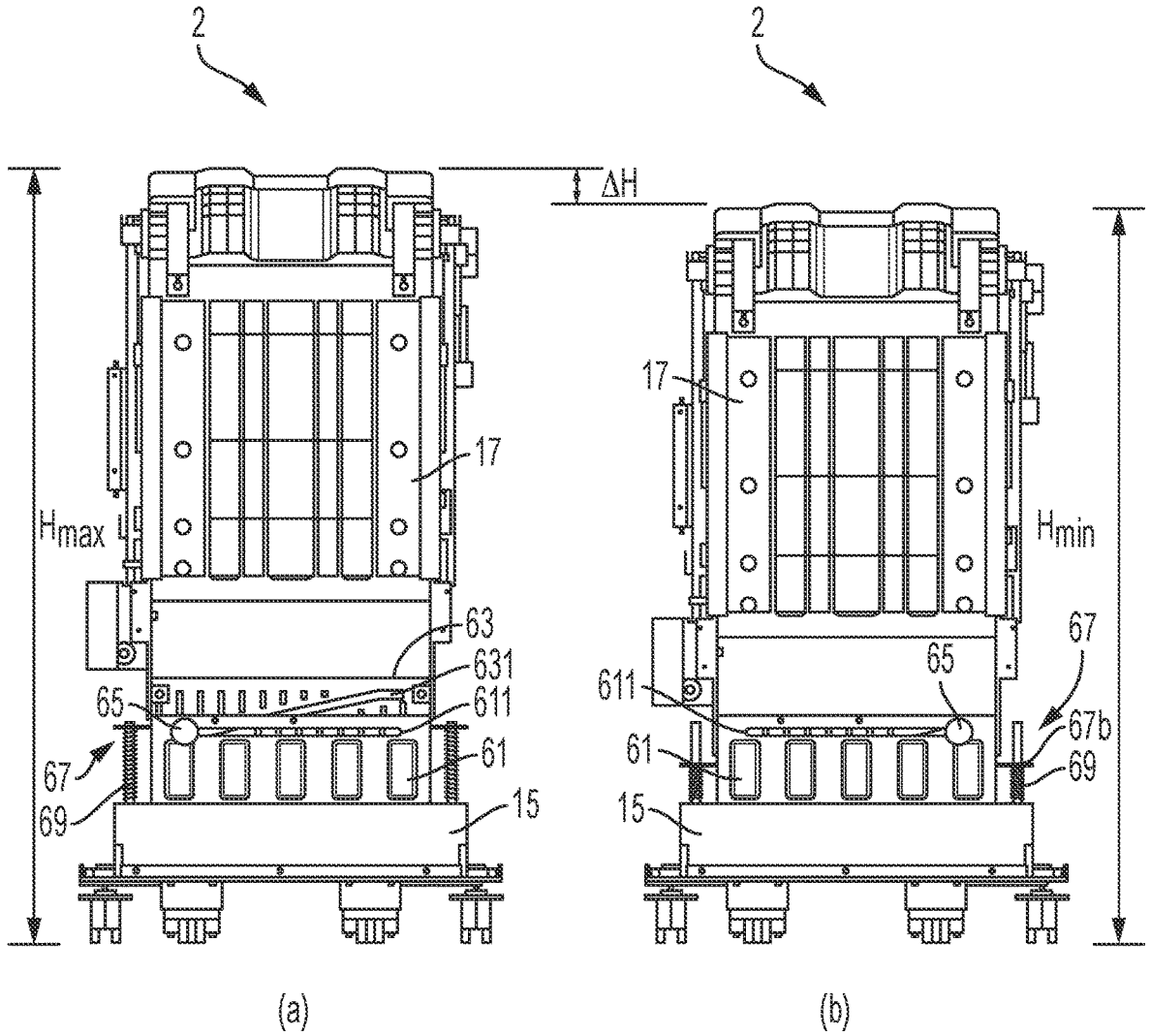
FIG. 7 illustrates a finisher at different heights based on operation of a height adjustment unit according to an example.

FIG. 4 is a schematic diagram of a finisher including a height adjustment unit according to an example. FIG. 5 is a schematic diagram of a height adjustment unit according to an example. FIG. 6 is a schematic diagram of a guide plate according to an example. FIG. 7 illustrates a finisher at different heights based on operation of a height adjustment unit according to an example. Descriptions of the first portion 10, the second portion 20, the stacker 30, the elevation driving unit 40, and the second stacker 50 shown in FIGS. 1-3 may also be applied to the example of the finisher 2 shown in FIGS. 4-7.

Referring to FIGS. 4 to 7, the finisher 2 may include the first portion 10 having the height adjustment unit 60. The height adjustment unit 60 may be used to adjust a height of the second portion 20 from an installation surface MS on which the finisher 2 is located. For example, the first portion 10 may include a base portion 15 and an upper portion 17. The height adjustment unit 60 may be coupled to the base portion 15 and the upper portion 17 and may operate to adjust a height of the upper portion 17 relative to the base portion 15. Because a distance or height of the second portion 20 relative to the upper portion 17 does not change, operation of the height adjustment unit 60 may adjust a height of the second portion 20 from the installation surface MS on which the finisher 2 is located.

The height adjustment unit 60 may include a base plate 61, a guide plate 63, and a slide lever 65. The base plate 61 may be coupled to the base portion 15 of the first portion 10 and the guide plate 63 may be coupled to the upper portion 17 of the first portion 10. As an example, the base plate 61 may be coupled to the base portion 15 by being integrally formed with the base portion 15, by using a connector such as a bolt, a screw, a bracket, etc., by being welded to the base portion 15, and the like. The guide plate 63 may be coupled to the upper portion 17 by being integrally formed with the upper portion 17, by using a connector such as a bolt, a screw, a bracket, etc., by being welded to the upper portion 17, and the like.

The base plate 61 may include a horizontal slot 611 located therein. The horizontal slot 611 may extend in a horizontal direction across the base plate 61. The horizontal direction may be a direction perpendicular to a force of gravity. For example, the horizontal direction may be perpendicular to the vertical direction.

The guide plate 63 may include an inclined slot 631 located therein. The inclined slot 631 may extend across the guide plate 63 at an angle relative to the horizontal direction. As an example, the inclined slot 631 may extend at an angle of 15° relative to the horizontal direction. The inclined slot 631 may include a first section 631*a*, a second section 631*b*, and a third section 631*c*. In an example, the first section 631*a* is inclined at an angle relative to the horizontal direction, for example at an angle of 15° relative to the horizontal direction, and the second section 631*b* and the third section 631*c* are parallel to the horizontal direction. In other examples, an angle of the inclined slot 631 and an angle of the first section 631*a* may be an angle other than 15°.

The slide lever 65 may couple the horizontal slot 611 and the inclined slot 631. For example, the slide lever 65 may include a shaft (e.g., shaft 653, FIG. 8A) that extends from a first side of the base plate 61, through the horizontal slot 611 located in the base plate 61 to a second side of the base plate 61 opposite to the first side of the base plate 61. The shaft of the slide lever 65 may continue past the second side of the base plate 61 to a first side of the guide plate 63, through the inclined slot 631 located in the guide plate 63, to a second side of the guide plate 63 opposite to the first side of the guide plate 63. In that case, the slide lever 65 couples the horizontal slot 611 and the inclined slot 631.

In operation, the slide lever 65 may be moved between opposite lateral sides of the horizontal slot 611. For example, the slide lever 65 may be moved between a leftmost side of the horizontal slot 611 and a rightmost side of the horizontal slot 611, which respectively correspond to a leftmost side of the inclined slot 631 and a rightmost side of the inclined slot 631. It is noted that the terms "leftmost" and "rightmost" are simply to designate opposite sides and are considered oriented in relation to the figure.

Based on movement of the slide lever 65 coupling the horizontal slot 611 and the inclined slot 631, a position (e.g., a height) of the guide plate 63 relative to the base plate 61 will change. As an example, FIG. 7 illustrates an orientation of the guide plate 63 relative to the base plate 61 based on a movement of the slide lever 65. In the example illustrated in frame (a), the slide lever 65 is located at a leftmost side of the horizontal slot 611 and the inclined slot 631, which results in an orientation of the guide plate 63 having a maximum height difference relative to the base plate 61. In that case, because the upper portion 17 of the finisher 2 is coupled to the guide plate 63, a height H of the second portion 20 from the installation surface MS on which the finisher 2 is located will be a maximum height $H_{max}$.

In the example illustrated in frame (b), the slide lever 65 is located at a rightmost side of the horizontal slot 611 and the inclined slot 631, which results in an orientation of the guide plate 63 having a minimum height difference relative to the base plate 61. In that case, because the upper portion 17 of the finisher 2 is coupled to the guide plate 63, a height H of the second portion 20 from the installation surface MS on which the finisher 2 is located will be a minimum height $H_{min}$.

As illustrated in FIG. 6, a difference in height (e.g., ΔH) of the second portion 20 between $H_{max}$ and $H_{min}$ may be established by the locations of the second section 631*b* and the third section 631*c* of the inclined slot 631. For example, the second section 631*b* may be at a first elevation ($h_1$) relative to a bottom edge of the guide plate 63 and the third section 631*c* may be at a second elevation ($h_2$) relative to the bottom edge of the guide plate 63. A difference in elevations (Δh) between the second section 631*b* and the third section 631*c* corresponds to the height difference (ΔH) of the second portion 20 as the slide lever 65 is moved between the leftmost and rightmost sides of the horizontal slot 611 and the inclined slot 631.

In the examples as illustrated in FIGS. 4-7, the first section 631*a* is inclined at an angle relative to the horizontal direction and the second section 631*b* and the third section 631*c* are parallel to the horizontal direction. In that case, the second section 631*b* and the third section 631*c* may receive the shaft of the slide lever 65 and provide a location at which the slide lever 65 may remain without further movement of the guide plate 63 relative to the base plate 61 (e.g., due to a force of gravity). Although not illustrated, each of the second section 631*b* and the third section 631*c* may include a recess, a detent, etc. having a size corresponding to the slide lever 65, such as a diameter of the shaft of the slide lever 65, to receive the slide lever 65 as it is moved to the second section 631*b* or the third section 631*c*. The recess, detent, etc. may assist in maintaining the slide lever 65 at the second section 631*b* or the third section 631*c* to maintain the finisher 2 at a selected height. Furthermore, although FIGS.

4-7 include an inclined slot 631 including the second section 631*b* and the third section 631*c*, this is merely for purpose of illustration. In other examples, the inclined slot 631 may include three or more horizontal sections. As an example, an inclined slot 631 including three horizontal sections may establish three different heights at which the second portion 20 may be located.

The height adjustment unit 60 may include a guiding unit 67 and an elastic body 69. In an example, the guiding unit 67 may include a stud 67*a* connected to the base portion 15 and a bushing 67*b* connected to the upper portion 17. The bushing 67*b* is to couple with the stud 67*a* to guide movement of the upper portion 17 relative to the base portion 15 as the slide lever 65 is moved between the leftmost and rightmost sides of the horizontal slot 611 and the inclined slot 631. In other examples, the guiding unit 67 may include a guide block, a sliding rail, a post, a channel, and the like.

The elastic body 69 is provided to reduce a force used to operate the slide lever 65. For example, operating the slide lever 65 to increase a height of the second portion 20 without installation of the elastic body 69 may use a force that is proportional to the full weight of the second portion 20, that is, the gravitational force acting on the second portion 20. Because the gravitational force acting on the second portion 20 may be high, the elastic body 69 may be included to provide a force opposite to the gravitational force operating on the second portion 20. In that case, the force used to operate the slide lever 65 may be reduced. In an example, a force of the elastic body 69 may be determined using a weight of the second portion 20 based on the slide lever 65 being located at a midpoint of the horizontal slot 611.

In the examples illustrated in FIGS. 4-7, the elastic body 69 is implemented as a compression spring. However, in other examples, the elastic body 69 may include a constant force spring, an extension spring, or the like. Also, the examples of FIGS. 4-7 illustrate that the compression spring is coupled to the stud 67*a*. However, in other examples, the elastic body 69 may be provided at another location that is intermediate the base portion 15 and the upper portion 17 such that the elastic body 69 is able to provide a force opposite to the gravitational force operating on the finishing unit 22.

Figure 8A:
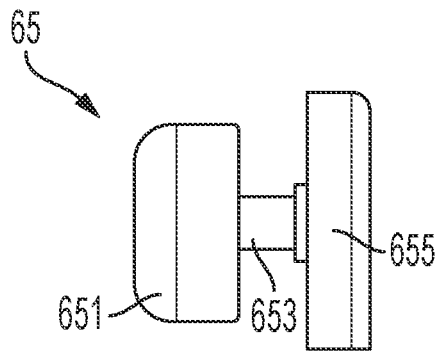
FIGS. 8A and 8B are schematic diagrams of a slide lever according to various examples.
Figure 8B:
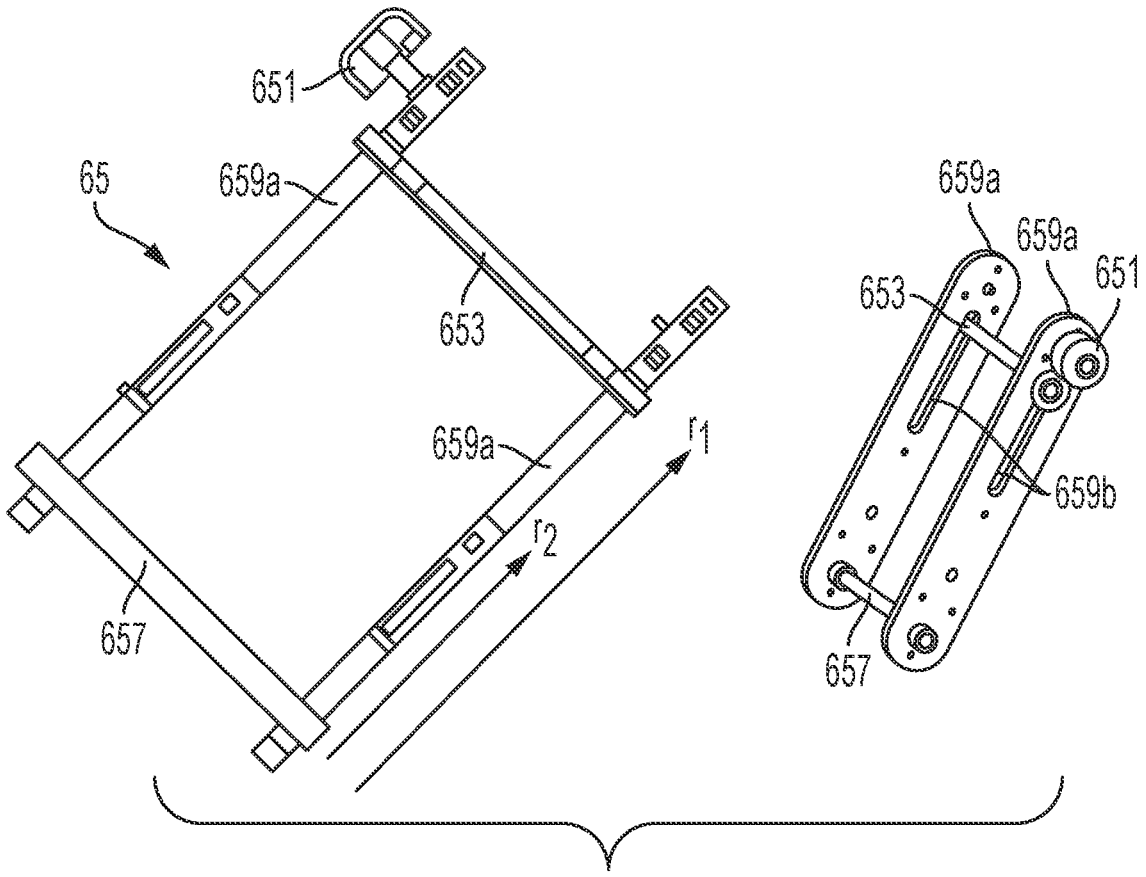

FIGS. 8A and 8B are schematic diagrams of a slide lever according to various examples.

Referring to FIG. 8A, the slide lever 65 may include a handle 651 and a shaft 653. As described above, the shaft 653 may penetrate the horizontal slot 611 and the inclined slot 631 and be movable within the horizontal slot 611 and the inclined slot 631. The slide lever 65 may also include a maintaining unit 655 that is to maintain the slide lever 65 coupled to the horizontal slot 611 and the inclined slot 631. As an example, the maintaining unit 655 may include a bolt, a screw, a cotter pin, a recessed ball, a bushing, and the like that is removably coupled with the slide lever 65. In the example of FIG. 8A, a bushing is illustrated as the maintaining unit 655.

Referring to FIG. 8B, frames (a) and (b) are different views illustrating the slide lever 65 including the handle 651 and the shaft 653. As illustrated in FIG. 8B, the slide lever 65 may further include a pivot member 657, a main body 659*a*, and a recess 659*b*. As will be described in more detail with reference to FIG. 9, the pivot member 657 may be coupled to a receiving portion of the base portion 15. The recess 659*b* may include a slot or elongated opening located in main body 659*a* to receive the shaft 653 and allow movement of the shaft 653 while maintaining the shaft 653 coupled to the main body 659*a*. As an example, an end of the shaft 653 may include a shoulder portion that couples with a side of the main body 659*a* adjacent to the recess 659*b*. In various examples, the shoulder may be formed integrally with the shaft 653, may include a washer secured to an end of the shaft 653 using a screw, a bolt, a rivet, or the like, and may include a bushing, a bearing, etc. The shaft 653 may extend through the recess 659*b* while being maintained within the recess 659*b* based on the shoulder portion and thus allow movement of the shaft 653 between positions $r_1$ and $r_2$ while maintaining the coupling of the shaft 653 to the main body 659*a*.

Figure 9:
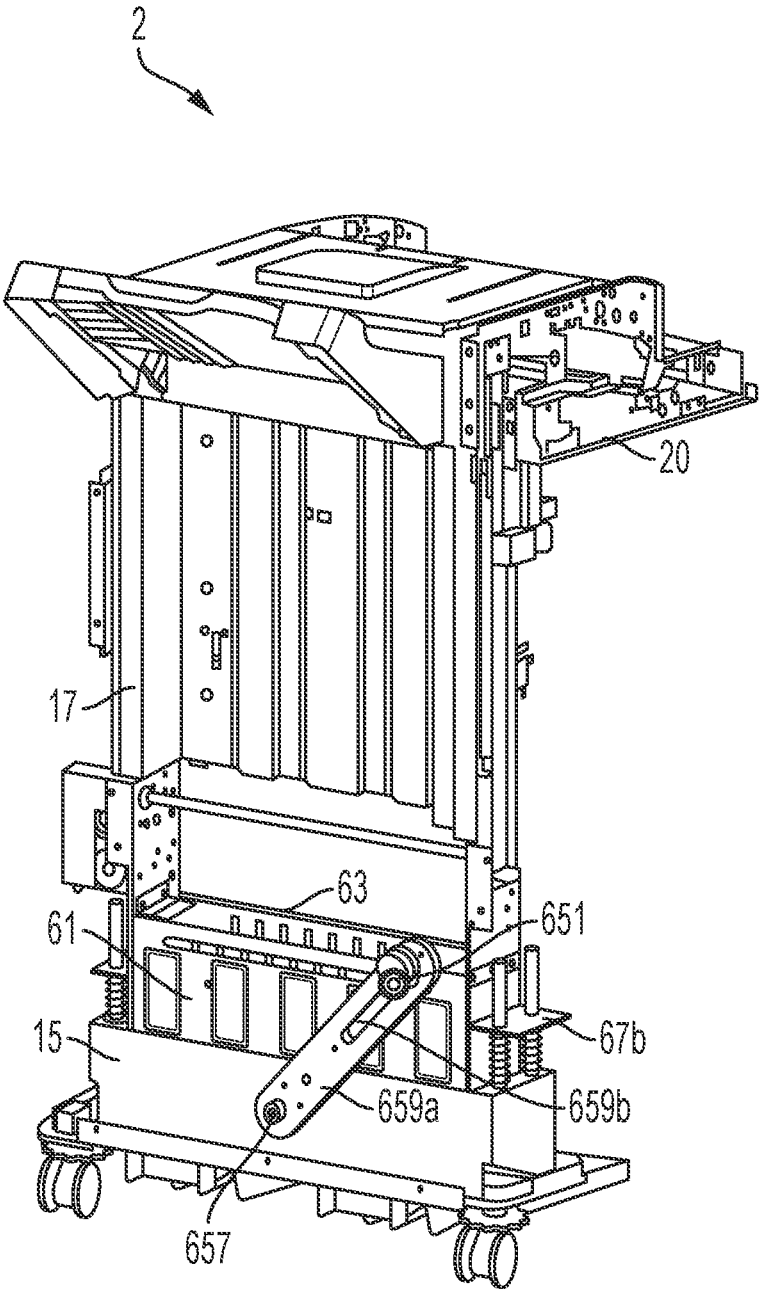
FIG. 9 illustrates a finisher including a slide lever having a pivot member according to an example.

FIG. 9 illustrates a finisher including a slide lever having a pivot member according to an example. Descriptions of the first portion 10, the second portion 20, the stacker 30, the elevation driving unit 40, the second stacker 50, the height adjustment unit 60, and the slide lever 65 shown in FIGS. 1 through 7 and 8B may also be applied to the example of the finisher 2 shown in FIG. 9.

Referring to FIG. 9, the finisher 2 includes a slide lever 65 as illustrated in FIG. 8B. For example, the slide lever 65 includes the pivot member 657, the main body 659*a*, and the recess 659*b* as well as the handle 651 and the shaft 653. The pivot member 657 may be received by a receiving portion of the base portion 15. For example, the receiving portion may include a recess, a hole, or the like having a shape and size corresponding to that of the pivot member 657. The receiving portion may further include a bushing, a bearing, or the like to assist in rotation of the pivot member 657 during operation of the slide lever 65.

In the example illustrated in FIG. 9, the slide lever 65 includes two main bodies 659*a* that are spaced apart by a distance corresponding to a separation of the base plate 61 from the guide plate 63. For example, a first main body 659*a* may be located adjacent to the first side of the base plate 61 and the second main body 659*a* may be located adjacent to the second side of the guide plate 63. The shaft 653 and the pivot member 657 may each extend between the first and the second main bodies 659*a*. In more detail, the receiving portion of the base portion 15 may extend through the base portion 15. In that case, the pivot member 657 may extend through the receiving portion to couple with the first and second main bodies 659*a* that are respectively adjacent to the base plate 61 from the guide plate 63. The pivot member 657 may be fixedly coupled to the first and second main bodies 659*a* to cause a movement of the slide lever 65 based on a rotation of the pivot member 657. The shaft 653 may extend between the first and the second main bodies 659*a* while extending through the horizontal slot 611 and the inclined slot 631 to couple the base plate 61 and the guide plate 63. In that case, each side of the shaft 653 may include a shoulder portion as described above to maintain a coupling of the shaft 653 to the main bodies 659*a* while the shaft 653 is movable within the recess 659*b*.

Referring again to FIG. 8B, as the slide lever 65 is located at a leftmost side or a rightmost side of the horizontal slot 611, a distance from the receiving portion of the base portion 15 to a location of the horizontal slot 611 at which the shaft 653 is located may be considered a first distance $r_1$. As the slide lever 65 is located at a center of the horizontal slot 611, a distance from the receiving portion of the base portion 15 to a location of the horizontal slot 611 at which the shaft 653 is located may be considered a second distance $r_2$. Because the distance $r_1$ is greater than the distance $r_2$, the shaft 653 of the slide lever 65 is moveable within the recess 659*b*.

Operation of the slide lever 65 illustrated in FIG. 9 to adjust the height of the finisher 2 is substantially the same as that described above. For example, as the slide lever 65 is moved between a leftmost side and a rightmost side of the horizontal slot 611, the height of the finisher 2 is adjusted as described with reference to FIG. 7.

Figure 10:
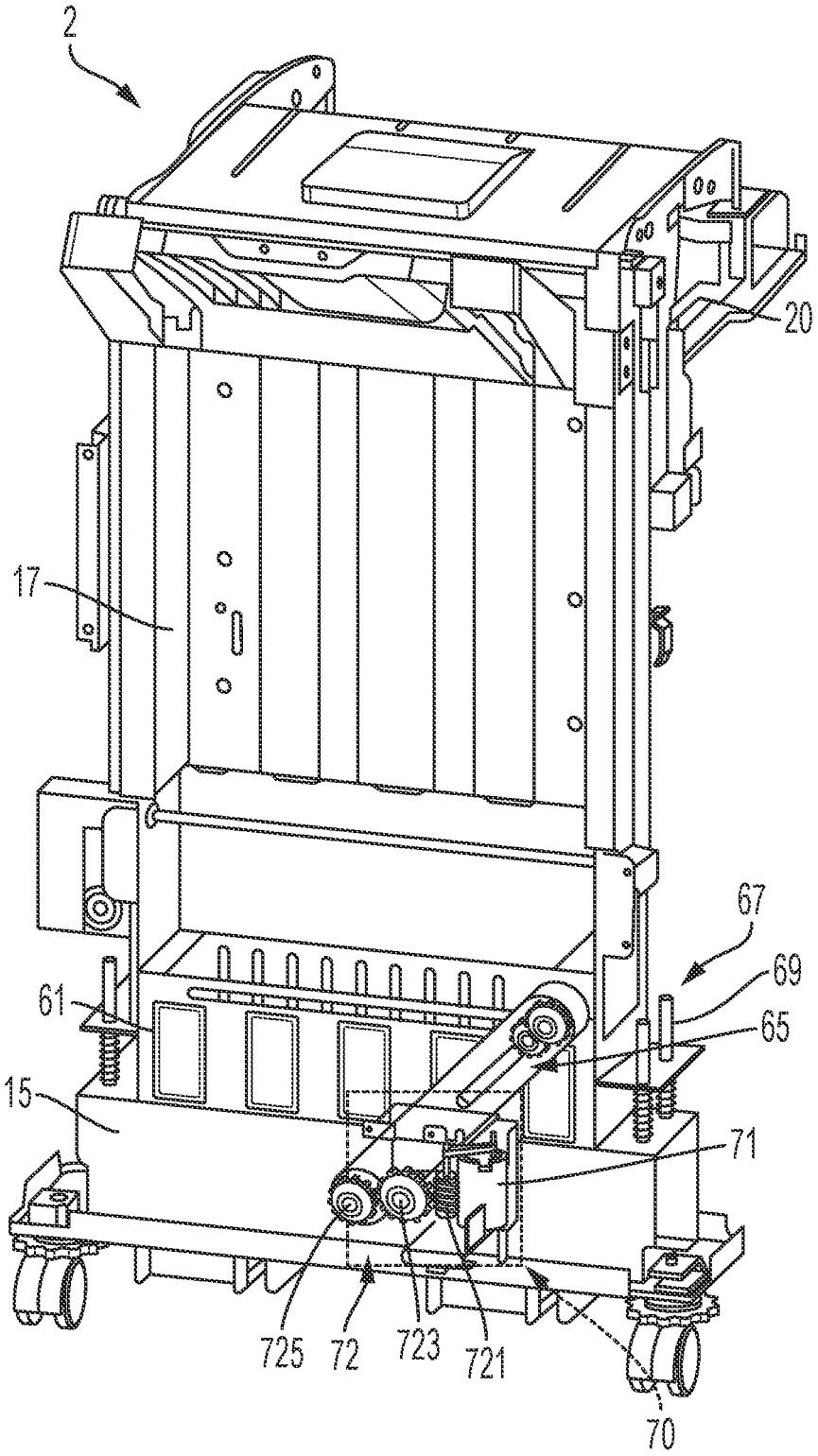
FIG. 10 illustrates a finisher including a motor driven slide lever according to an example.
Figure 11:
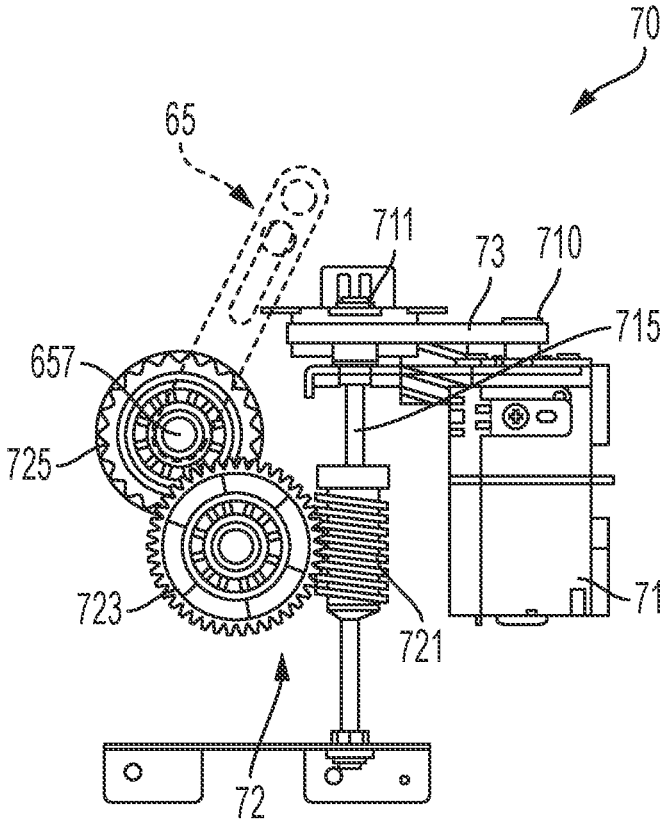
FIG. 11 is a schematic diagram of a drive unit according to an example.

FIG. 10 illustrates a finisher including a motor driven slide lever according to an example. FIG. 11 is a schematic diagram of a drive unit according to an example. Descriptions of the first portion 10, the second portion 20, the stacker 30, the elevation driving unit 40, the second stacker 50, and the height adjustment unit 60 including the slide lever 65 as shown in FIGS. 1-7, 8B, and 9 may also be applied to the example of the finisher 2 shown in FIGS. 10 and 11.

Referring to FIGS. 10 and 11, the finisher 2 may include a drive unit 70 including a motor 71 and a gear assembly 72. In the example illustrated in FIG. 10, the drive unit 70 is located within the base portion 15.

In an example, the gear assembly 72 is to be driven by the motor 71. The gear assembly 72 may include a worm roller 721, a worm wheel 723, and a slide lever gear 725. The slide lever gear 725 may be coupled to the slide lever 65. For example, the slide lever gear 725 may be coupled to the pivot member 657 of the slide lever 65. In an example, the slide lever gear 725 may have an axis of rotation the same as that of the pivot member 657. For example, the slide lever gear 725 may be integrally formed with the pivot member 657. In that case, rotation of the slide lever gear 725 may control rotation of the first and second main bodies 659*a* around the receiving portion of the base portion 15, based on their fixed connection to pivot member 657, and a corresponding movement of the slide lever 65 between opposite sides of the horizontal slot 611 and the inclined slot 631. Thus, the drive unit 70 may be operated to control a motion of the slide lever 65 and thus control a height adjustment of the second portion 20.

As illustrated in FIG. 11, the drive unit 70 may include the motor 71 and the gear assembly 72. The motor 71 may include an output shaft having a motor gear 710 located at an end of the output shaft. Although not illustrated, the motor 71 may further include a cord, a cable, a wire, etc. to receive power, a control signal, etc. or to provide motor information to a control unit (e.g., FIG. 15, control unit 80). In an example, the motor 71 may include a stepper motor.

A belt 73 may be coupled to the motor gear 710 and be driven by a rotation of the motor gear 710. The belt 73 may also be coupled to a motor driven gear 711. A gear shaft 715 may include a first end coupled to the motor driven gear 711 and a second end coupled to the worm roller 721. The gear shaft 715 may be driven by rotation of the motor driven gear 711, which in turn may cause a rotation of the worm roller 721. The worm roller 721 is coupled to the worm wheel 723 such that a rotation of the worm roller 721 will cause a rotation of the worm wheel 723. The worm wheel 723 may be coupled to the slide lever gear 725. As an example, the worm wheel 723 may be directly coupled to the slide lever gear 725 or include a reducing gear to obtain a desired gear ratio between the worm wheel 723 and the slide lever gear 725.

In an example operation of the drive unit 70 to control a height adjustment of the second portion 20, the motor 71 may be controlled to rotate a certain number of revolutions to control an operation of the slide lever 65. For example, a rotation of the motor 71 and a corresponding rotation of the output shaft and motor gear 710, may cause a rotation of the motor driven gear 711 through the coupling of the motor driven gear 711 to the motor gear 710 by the belt 73. Based on its coupling to the motor driven gear 711, the gear shaft 715 is rotated corresponding to a rotation of the motor driven gear 711, which in turn causes a corresponding rotation of the worm roller 721. The worm roller 721 is coupled to the worm wheel 723 such that a rotation of the worm roller 721 will cause a rotation of the worm wheel 723. The worm wheel 723 may directly couple to the slide lever gear 725 or may include a gear reducer to change a gear ratio between the worm wheel 723 and the slide lever gear 725. In either case, a rotation of the worm wheel 723 may cause a rotation of the slide lever gear 725 and thus a rotation and corresponding movement of the slide lever 65 within the horizontal slot 611 and the inclined slot 631, thus causing a desired height adjustment of the second portion 20.

Various changes may be made in other examples of the drive unit 70. For example, an output of the motor 71 may be directly coupled to the gear shaft 715 and worm roller 721 without the use of the motor gear 710, the motor driven gear 711, or the belt 73. As another example, the worm roller 721 may directly couple with the slide lever gear 725 without the use of the worm wheel 723. Moreover, a gear ratio between any of the motor gear 710, the motor driven gear 711, the worm roller 721, the worm wheel 723, and the slide lever gear 725 may be selected based on various design implementations and variables such as a weight of the finishing unit 22, a desired output or holding force (e.g., torque), etc.

In other examples, the finisher 2 that includes the drive unit 70 may include a guide plate 63 having an inclined slot 631 that does not include the second section 631*b* or the third section 631*c*. In that case, a holding position of the slide lever 65 relative to the inclined slot 631 may be controlled by a rotation of the motor 71 and gear assembly 72. That is, the motor 71 and gear assembly 72 may have sufficient holding torque to maintain a position of the slide lever 65 at any location along the inclined slot 631 without the use of the second section 631*b* or the third section 631*c*.

In another example, the finisher 2 that includes the drive unit 70 may not include the elastic body 69. That is, the drive unit 70 may provide a driving force to the slide lever gear 725 and the slide lever 65 that is sufficient to lift the weight of the second portion 20 without the assistance of the force from the elastic body 69.

Figure 12A:
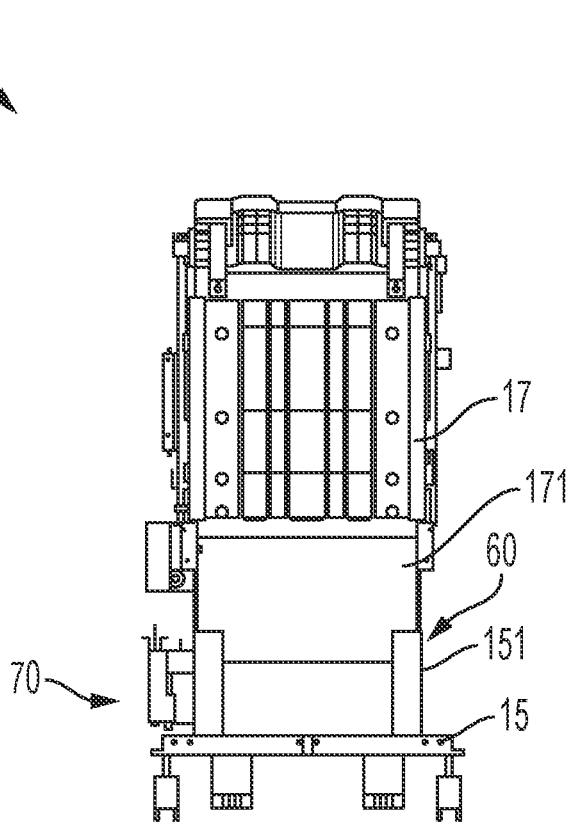
FIGS. 12A and 12B illustrate a finisher including a height adjustment unit according to an example.
Figure 12B:
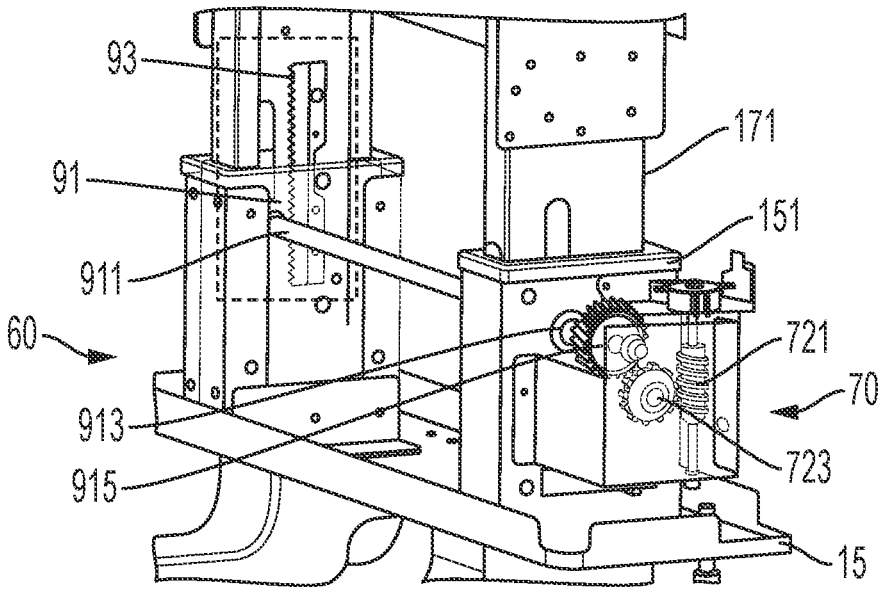

FIGS. 12A and 12B illustrate a finisher including a height adjustment unit according to an example. FIGS. 13A-13E are schematic diagrams illustrating elements of a height adjustment unit including a rack gear and a pinion gear according to an example. FIG. 14 is a schematic diagram of a drive unit according to an example. Descriptions of the first portion 10, the second portion 20, the stacker 30, the elevation driving unit 40, and the second stacker 50 shown in FIGS. 1 through 7 may also be applied to the example of the finisher 2 shown in FIGS. 12A and 12B.

Referring to FIGS. 12A, 12B, 13A-13E, and 14, the finisher 2 includes the base portion 15, the upper portion 17, the height adjustment unit 60, and the drive unit 70. In the illustrated example, the height adjustment unit 60 includes a pinion gear 91 and a rack gear 93. The pinion gear 91 may be coupled to the base portion 15 and the rack gear 93 may be coupled to the upper portion 17.

In an example, the pinion gear 91 may include an axle 911 having a bearing 913 at an end thereof. The bearing 913 may engage with a frame base 151 of the base portion 15 to maintain the bearing 913 and the axle 911 at a certain location. For example, the frame base 151 may include a recess 151*a* to receive the bearing 913 of the pinion gear 91. The pinion gear 91 may also include a pinion drive gear 915 that is to engage with the drive unit 70. In operation, the pinion gear 91 may be rotated on the axle 911 while remaining at the certain location based on the engagement of the bearing 913 with the frame base 151.

In an example, the rack gear 93 may be coupled to a frame column 171 of the upper portion 17. As an example, the rack gear 93 may be coupled to the frame column 171 by being integrally formed with the frame column 171, by using a connector such as a bolt, a screw, a bracket, etc., by being welded to the frame column 171, and the like. The rack gear 93 is to couple with the pinion gear 91. In operation, as the pinion gear 91 rotates, the rack gear 93 is caused to move in the vertical direction. Based on the coupling of the rack gear 93 to the frame column 171, the vertical movement of the rack gear 93 causes vertical movement of the frame column 171 and a height adjustment of the second portion 20.

The frame column 171 may include an idle roller 171*a*, a moving roller 171*b*, and a frame slot 171*c*. The frame base 151 may include a channel 151*b* to receive the idle roller 171*a* and an inside wall 151*c* to contact the moving roller 171*b*. In operation, as the pinion gear 91 is rotated to cause a vertical movement of the rack gear 93, the frame column 171 moves vertically with respect to the frame base 151. In that case, the idle roller 171*a* rotates based on contact within the channel 151*b* and the moving roller 171*b* rotates based on contact with the inside wall 151*c*. Engagement of the idle roller 171*a* and the moving roller 171*b* with the channel 151*b* and the inside wall 151*c* respectively may prevent tilting of the finisher 2 and support a weight of the finisher 2 as it is moved in the vertical direction. In the illustrated example, two idle rollers 171*a* and one moving roller 171*b* are shown on each frame column 171. However, there may be more or fewer idle rollers 171*a* and may be more moving rollers 171*b* in implementation.

Figure 13A:
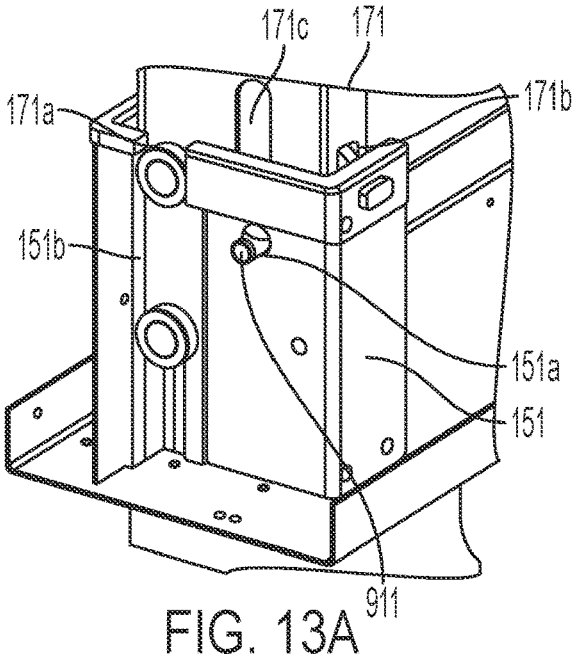
FIGS. 13A-13E are schematic diagrams illustrating elements of a height adjustment unit including a rack gear and a pinion gear according to an example.
Figure 14:
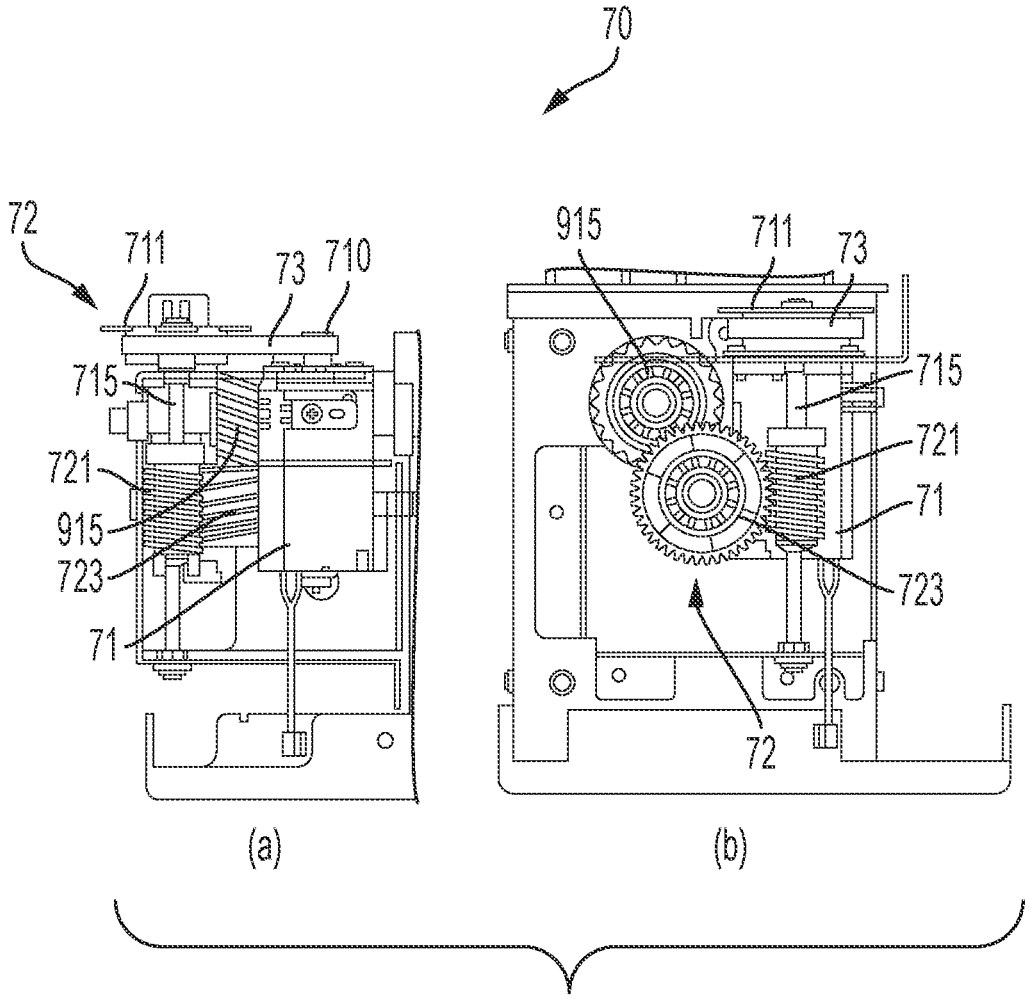
FIG. 14 is a schematic diagram of a drive unit according to an example.

In more detail, FIG. 13A illustrates engagement of the frame column 171 and the frame base 151. In FIG. 13A, example locations of the recess 151*a* within the frame base 151 and the frame slot 171*c* of the frame column 171 are illustrated. FIG. 13A also includes a cutaway view of the frame base 151 illustrating the channel 151*b* that is to receive and engage with the idle rollers 171*a* as well as the inside wall 151*c* of the frame base 151 that is to engage with the moving roller 171*b*.

Figure 13B:
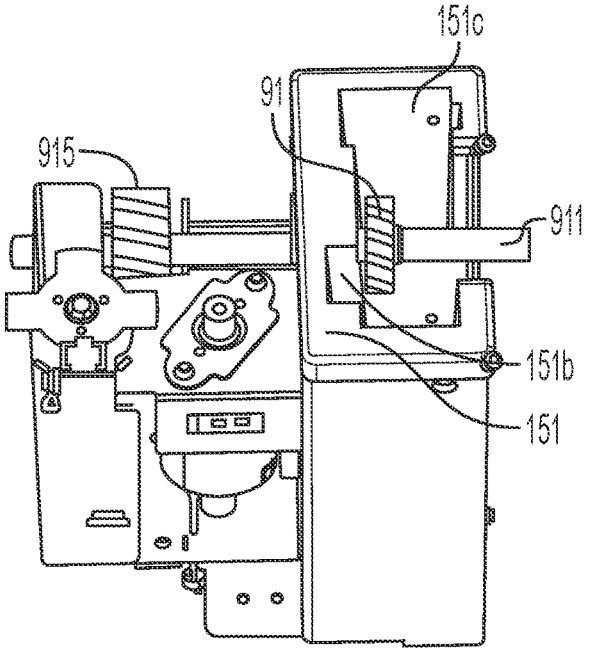
Figure 13C:
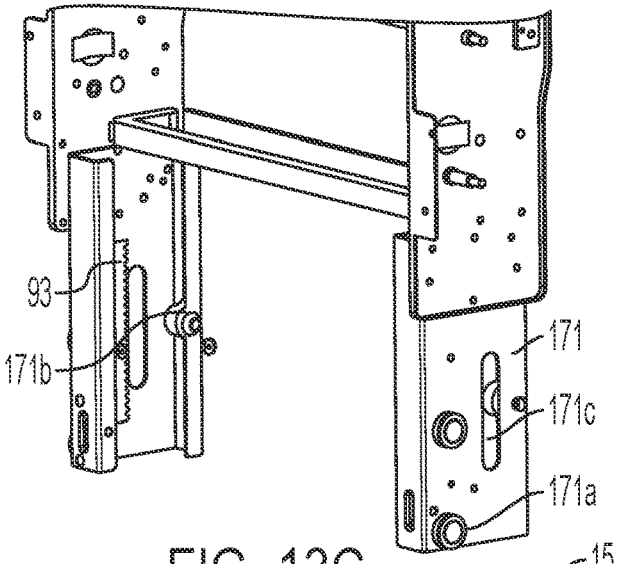
Figure 13D:
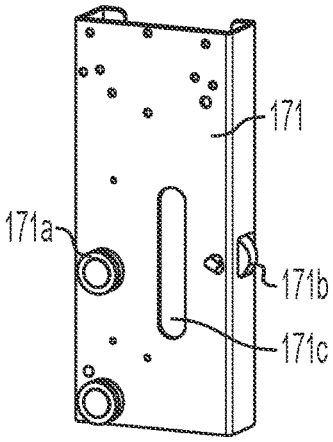
Figure 13E:
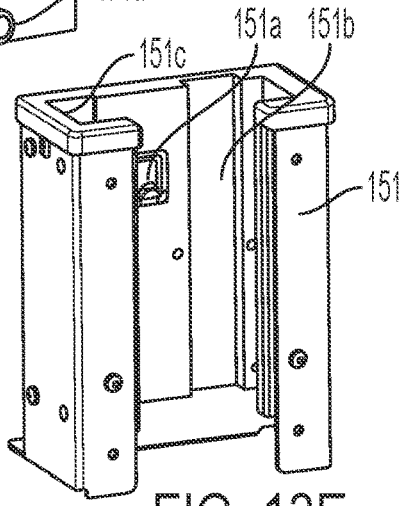

FIGS. 13B and 13E illustrate a top view and a side view of the frame base 151 showing example orientations of the recess 151*a*, the channel 151*b*, and the inside wall 151*c*. In FIG. 13B, an example of the pinion gear 91 is shown within the frame base 151 at a location to engage with the rack gear 93 as the frame column 171 is engaged with the frame base 151. The axle 911 is shown extending from the location of the pinion gear 91 toward an opposite side of the finisher 2 as well as extending to the pinion drive gear 915 at a location outside of the frame base 151. The axle 911 extends from the pinion gear 91 toward the pinion drive gear 915 through the recess 151*a* provided in the frame base 151. As the axle 911 passes through the recess 151*a*, it is coupled with the bearing 913 to assist in rotation of the axle 911.

FIGS. 13C and 13D illustrate examples of the frame column 171 including the idle roller 171*a*, the moving roller 171*b*, and the frame slot 171*c*. In the illustrated example, the idle roller 171*a* is provided on a first side of the frame column 171 and the moving roller 171*b* is provided on a second side that is opposite the first side of the frame column 171. The frame slot 171*c* is provided as an opening within the frame column 171 at a location between the idle roller 171*a* and the moving roller 171*b*. In the illustrated example, the rack gear 93 is located on the second side of the frame column 171.

FIG. 14 is a schematic diagram of a drive unit according to an example. The example of a drive unit illustrated in FIG. 14 is similar to the drive unit 70 illustrated in FIG. 11 and a repetition of terms and descriptions of components illustrated in FIG. 11 will not be provided for conciseness.

Referring to FIG. 14, frame (a) illustrates a front view of the drive unit 70 and frame (b) illustrates a side view of the drive unit 70 as it is oriented with respect to the finisher 2 of FIGS. 12A, 12B, and 13A-13E.

Referring to FIG. 11, the drive unit 70 may include the motor 71 and the gear assembly 72. The motor 71 may include the output shaft having the motor gear 710 located at an end of the output shaft. The belt 73 may be coupled to the motor gear 710 and driven by a rotation of the motor gear 710. The belt 73 may also be coupled to the motor driven gear 711. The gear shaft 715 may include the first end coupled to the motor driven gear 711 and the second end coupled to the worm roller 721. The gear shaft 715 may be driven by rotation of the motor driven gear 711, which in turn may cause a rotation of the worm roller 721. The worm roller 721 is coupled to the worm wheel 723 such that a rotation of the worm roller 721 will cause a rotation of the worm wheel 723. The worm wheel 723 may be coupled to the pinion drive gear 915. As an example, the worm wheel 723 may be directly coupled to the pinion drive gear 915 or include a reducing gear to obtain a desired gear ratio between the worm wheel 723 and the pinion drive gear 915.

In an example operation of the drive unit 70 to control a height adjustment of the second portion 20, the motor 71 may be controlled to rotate a certain number of revolutions to control a rotation of the pinion gear 91. For example, a rotation of the motor 71 and a corresponding rotation of the output shaft and motor gear 710, may cause a rotation of the motor driven gear 711 through the coupling of the motor driven gear 711 to the motor gear 710 by the belt 73. Based on its coupling to the motor driven gear 711, the gear shaft 715 is rotated corresponding to a rotation of the motor driven gear 711, which in turn causes a corresponding rotation of the worm roller 721. The worm roller 721 is coupled to the worm wheel 723 such that a rotation of the worm roller 721 will cause a rotation of the worm wheel 723. The worm wheel 723 may directly couple to the pinion drive gear 915 or may include a gear reducer to change a gear ratio between the worm wheel 723 and the pinion drive gear 915. In either case, a rotation of the worm wheel 723 may cause a rotation of the pinion gear 91. In that case, as the pinion gear 91 is coupled to the rack gear 93, rotation of the pinion gear 91 causes a vertical movement of the rack gear 93. As the rack gear is coupled to the frame column 171 which supports the second portion 20, a desired height adjustment may be obtained.

In an example operation of adjusting a height of a finisher 2 including a drive unit 70, the finisher 2 may communicate with an image forming apparatus 1 to obtain an appropriate height to connect the finisher 2 to the image forming apparatus 1. For example, the finisher 2 may obtain a docking height of the image forming apparatus 1 at which the second portion 20 of the finisher 2 may be received by a concave loading portion 16 of the image forming apparatus 1. In an example, the finisher 2 may include a control unit to obtain an appropriate height of the second portion 20 based on information of the image forming apparatus 1 and to operate the drive unit 70 to adjust a height of the second portion 20. An example control unit is described with reference to FIG. 15.

Figure 15:
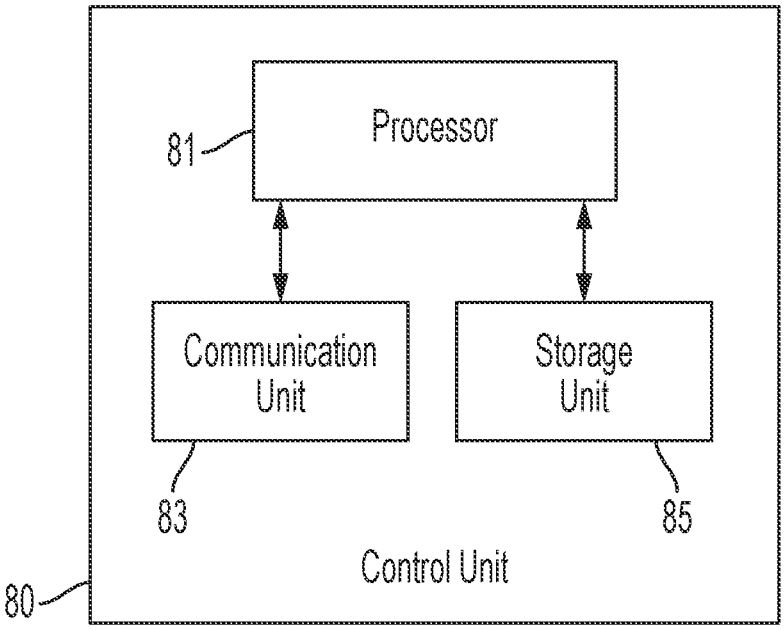
FIG. 15 is a schematic diagram of a control unit of a finisher according to an example.

FIG. 15 is a schematic diagram of a control unit of a finisher according to an example.

Referring to FIG. 15, a control unit 80 may include a processor 81, a communication unit 83, and a storage unit 85. The control unit 80 may be implemented by an integrated circuit or a chip that is located on a control board of the finisher 2, such as located on the base portion 15. In an example, the control unit 80 may be included in circuitry controlling the elevation driving unit 40.

The processor 81 may be a single device such as a central processing unit (CPU) or a microcontroller (MCU) and may also be a plurality of devices such as a clock generation circuit, a CPU, and a graphics processor. The processor 81 may execute a command stored in the storage unit 85 or may store information in the storage unit 85 and read the stored information. In an example, the processor 81 may receive information from the communication unit 83, obtain information from the storage unit 85, or perform an operation to control the drive unit 70. In an example, the processor 81 may control an operation of the drive unit 70 to adjust a height of the second portion 20.

The communication unit 83 enables the control unit 80 to communicate with other devices. In an example, the communication unit 83 may communicate with the image forming apparatus 1. The communication unit 83 may include various communication modules such as a wireless communication module or a wired communication module. The wireless communication module may be a module that supports, for example, Wi-Fi, Wi-Fi Direct, Bluetooth, Ultra-Wide Band (UWB), Long-Term Evolution (LTE), and Long-Term Evolution-Advanced (LTE-A), 5G, or Near Field Communication (NFC). The wired communication module may be a module that supports Local Area Network (LAN), Universal Serial Bus (USB), High Definition Multimedia Interface (HDMI), and the like. In an example, the communication unit 83 may also receive power through a wired communication module and provide the received power to the processor 81. In another example, the control unit 80 may include a separate power supply (not illustrated) that provides power to the components of the finisher 2 including the processor 81.

The storage unit 85 may be implemented by various storage media, such as a random access memory (RAM) or a read-only memory (ROM), which may store data. The storage unit 85 may store various types of information and may store, for example, an instruction executable by the processor 81, information on the image forming apparatus 1, and the like. In an example, the storage unit 85 stores information regarding an image forming apparatus 1. For example, the storage unit 85 may store information regarding a docking height of an image forming apparatus 1, such as a height of a concave loading portion 16 of the image forming apparatus 1 and may store docking height information corresponding to a plurality of image forming apparatuses 1. In that case, the storage unit 85 may store information such as a lookup table that correlates a docking height with identification information of an image forming apparatus 1.

In an example, the finisher 2 may establish communication with an image forming apparatus 1 using communication unit 83. The communication unit 83 may receive identification information of the image forming apparatus 1 and obtain a docking height of the image forming apparatus 1 using the received identification information. By comparing the docking height of the image forming apparatus 1 with a current height of the second portion 20, the processor 81 may control the drive unit 70 to automatically adjust a height of the second portion 20. The processor 81 may also control the communication unit 83 to transmit docking instructions to the image forming apparatus 1. For example, the processor 81 may obtain the docking instructions from the storage unit 85 and transmit the docking instructions to the image forming apparatus 1 using the communication unit 83.

Figure 16:
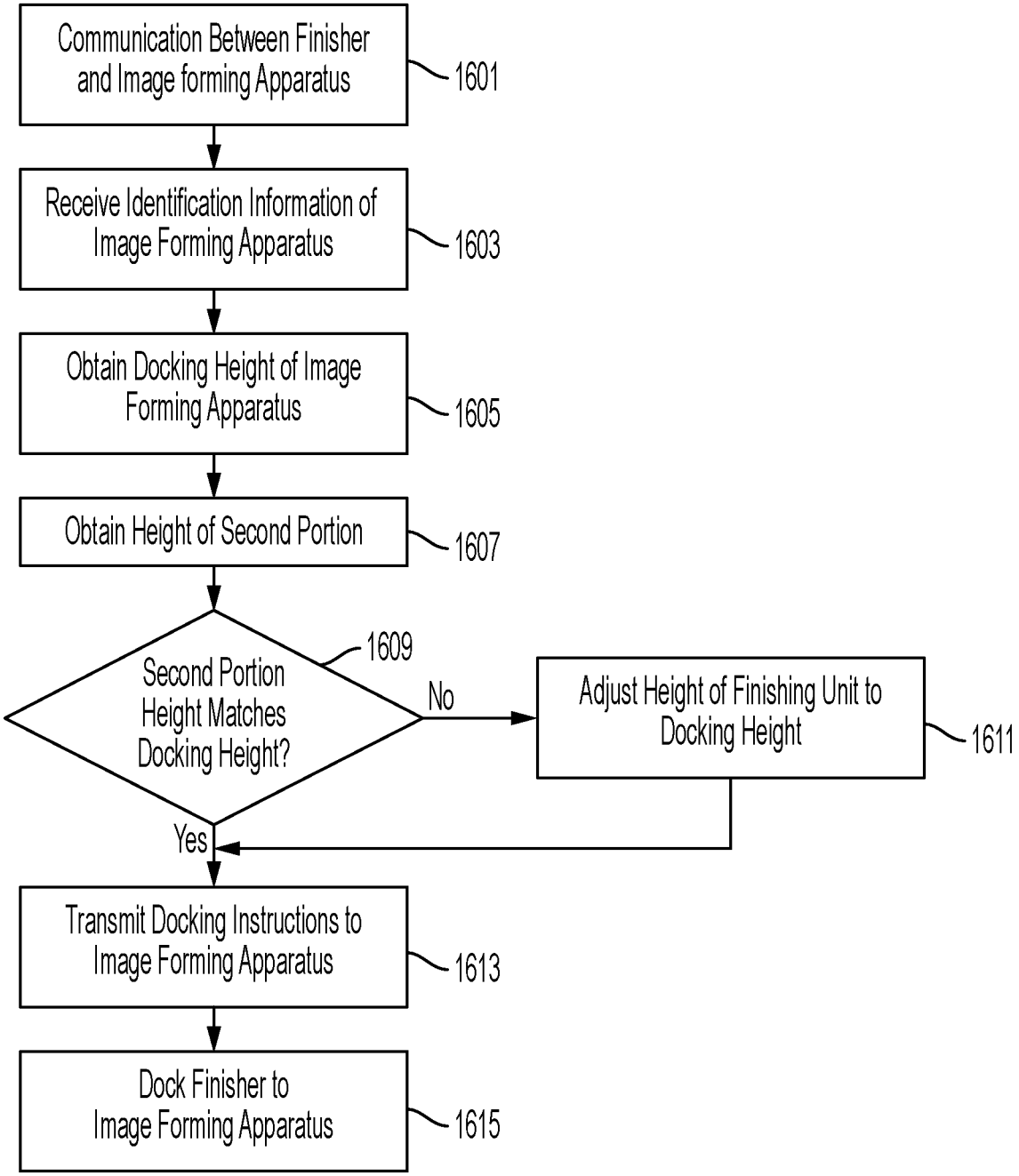
FIG. 16 is a flowchart illustrating operations for automatically controlling a height of a finisher according to an example.

FIG. 16 is a flowchart illustrating operations for automatically controlling a height of a finisher according to an example.

Referring to FIG. 16, a communication unit 83 of a finisher 2 may establish communication between the finisher 2 and the image forming apparatus 1 in operation 1601. As an example, a wired or a wireless communication path may be established between the communication unit 83 of the finisher 2 and a similar communication unit of the image forming apparatus 1. As described above, the communication unit 83 may establish a wired or wireless communication path using any of various methods (e.g., USB, HDMI, 5G, NFC, etc.). In an example in which the finisher 2 establishes a communication path using a wireless method, the finisher may obtain power to operate the control unit 80, the drive unit 70, and other components of the finisher 2 from a separate power source.

In operation 1603, identification information of the image forming apparatus 1 may be received by the finisher 2 using the communication path. As an example, the image forming apparatus 1 may transmit information such as a model number, a serial number, a manufacturer, docking height information, and the like. The identification information of the image forming apparatus that is received by the finisher 2 may be received by the communication unit 83 and stored in the storage unit 85.

In operation 1605, the finisher 2 obtains a docking height of the image forming apparatus 1. For example, the docking height of the image forming apparatus 1 may refer to a height of a concave loading portion 16 of the image forming apparatus 1 that is to receive the second portion 20 including the finishing unit 22 of the finisher 2. In an example, the docking height of the image forming apparatus 1 may be included in the identification information received in operation 1603. In another example, the docking height of the image forming apparatus 1 may be obtained by the processor 81 of the finisher 2 using the identification information received in operation 1603. As an example, the processor 81 of the finisher 2 may compare the identification information of the image forming apparatus 1 received in operation 1603 with information contained in the storage unit 85. The information contained in the storage unit 85 may include a lookup table that lists docking height information corresponding with the image forming apparatus identification information. As such, the processor 81 may obtain the corresponding docking height of the image forming apparatus 1 from the storage unit 85 using the identification information of the image forming apparatus 1 received in operation 1603.

In operation 1607, the finisher 2 obtains a height of the second portion 20. As an example, the height of the second portion 20 may be stored in the storage unit 85 based on a most recent height adjustment of the second portion 20 using the drive unit 70.

In operation 1609, the height of the second portion 20 is compared with the docking height of the image forming apparatus 1. If the height of the second portion 20 does not match the docking height of the image forming apparatus 1, the height of the second portion 20 is automatically adjusted in operation 1611. For example, if the height of the second portion 20 is greater than or less than the docking height of the image forming apparatus 1, the processor 81 may control the drive unit 70 to automatically decrease or increase the height of the second portion 20 to match the docking height of the image forming apparatus 1. After automatically adjusting the height of the second portion 20, the method proceeds to operation 1613. On the other hand, if the height of the second portion 20 matches the docking height of the image forming apparatus 1, the method proceeds to operation 1613.

In operation 1613, the finisher 2 transmits docking instructions to the image forming apparatus 1. For example, the processor 81 of the finisher 2 may obtain docking instructions from the storage unit 85 and transmit that docking instructions to the image forming apparatus 1 using the communication unit 83. The docking instructions may include written instructions that may be read by a user to assist the user in docking the finisher 2 to the image forming apparatus 1. For example, the written docking instructions may be displayed on a touchscreen of the image forming apparatus 1 to be read by the user. In another example, the docking instructions may include a graphical user interface (GUI) that is transmitted to the image forming apparatus 1 for display on the touchscreen. The GUI may illustrate actions for a user to follow to dock the finisher 2 to the image forming apparatus 1.

In operation 1615, the finisher 2 is docked to the image forming apparatus 1 using the docking instructions provided in operation 1613.

Figure 17:
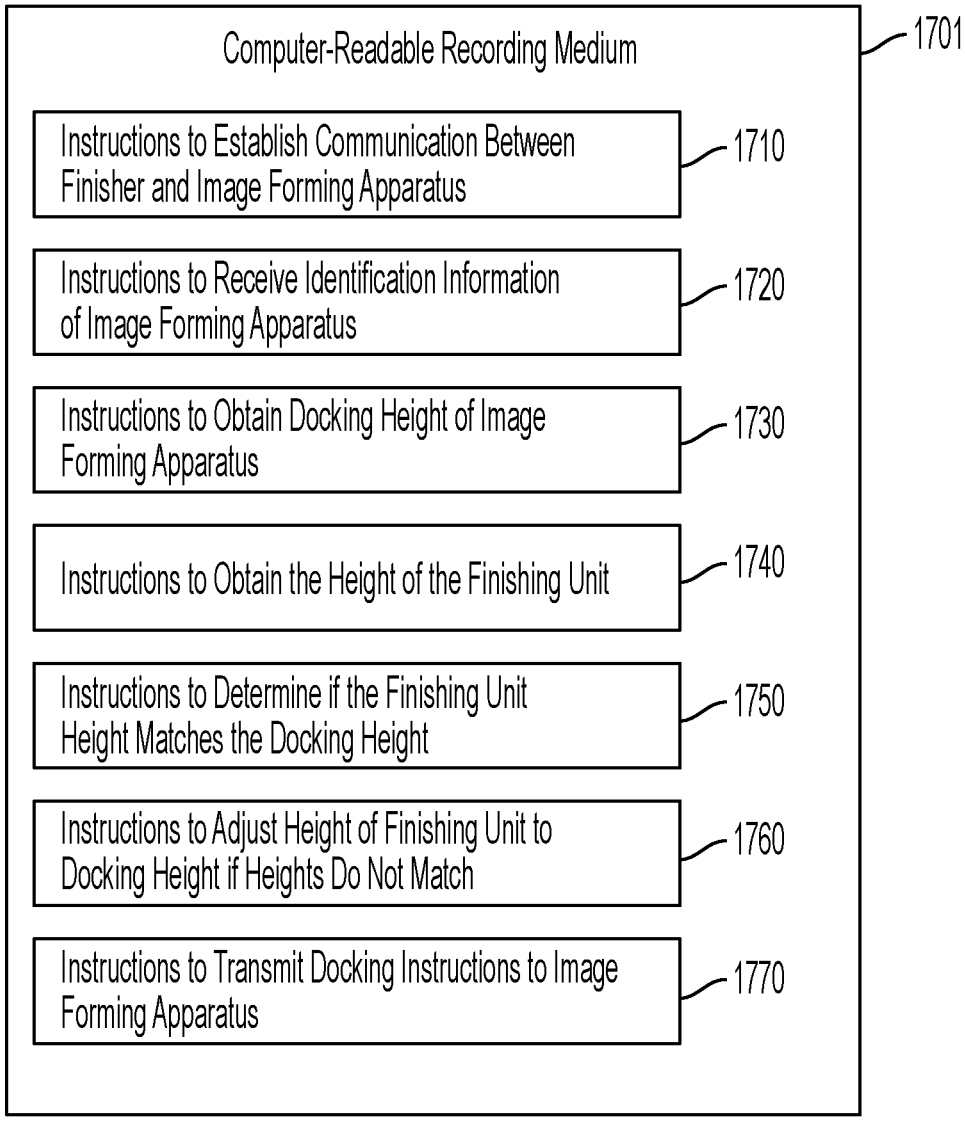
FIG. 17 is a schematic diagram of a non-transitory computer-readable recording medium including instructions to perform an automatic docking method according to an example.

FIG. 17 is a schematic diagram of a non-transitory computer-readable recording medium including instructions to perform an automatic docking method according to an example.

Referring to FIG. 17, a non-transitory computer-readable recording medium 1701 may include instructions 1710 through 1770. Instructions 1710 may be provided to establish communication between a finisher 2 and an image forming apparatus 1. Instructions 1720 may be provided to receive identification information of the image forming apparatus 1. Instructions 1730 may be provided to obtain a docking height of the image forming apparatus 1. Instructions 1740 may be provided to obtain the height of the second portion 20. Instructions 1750 may be provided to compare the height of the second portion 20 with the docking height of the image forming apparatus 1. Instructions 1760 may be provided to automatically adjust a height of the second portion 20 to the docking height of the image forming apparatus 1 if the heights do not match. Instructions 1770 may be provided to transmit docking instructions to the image forming apparatus 1.

It should be understood that examples described herein should be considered in a descriptive sense and not for purposes of limitation. Descriptions of features or aspects within each example should typically be considered as available for other similar features or aspects in other examples. While various examples have been described with reference to the figures, it will be understood that various changes in form and details may be made therein without departing from the spirit and scope as defined by the following claims.

What is claimed is:

1. A finisher comprising:

a first portion extending in a vertical direction and including a height adjustment unit;

a second portion extending from the first portion in a lateral direction and including a finishing unit to perform a finishing process; and a stacker to receive paper discharged from the finishing unit, the stacker extending in an opposite direction to the second portion in the lateral direction, wherein the height adjustment unit is to adjust a height of the second portion from an installation surface, the height adjustment unit including:

a base plate including a horizontal slot;

a guide plate including an inclined slot; and a slide lever coupling the horizontal slot and the inclined slot.

2. The finisher of claim 1, wherein the inclined slot includes a first section that is inclined relative to the horizontal slot, and a second section that is parallel to the horizontal slot.

3. The finisher of claim 1, wherein the height adjustment unit further comprises:

a guiding unit including a stud, a post, a rail, a bushing, or a guide block; and an elastic body including a compression spring, a constant force spring, or an extension spring.

4. The finisher of claim 1, wherein the height adjustment unit further comprises:

a motor; and a gear assembly to be driven by the motor to move the slide lever.

5. The finisher of claim 4, further comprising:

a storage unit; and a processor to control an operation of the motor.

6. A finisher comprising:

a first portion extending in a vertical direction and including a height adjustment unit;

a second portion extending from the first portion in a lateral direction and including a finishing unit to perform a finishing process; and a stacker to receive paper discharged from the finishing unit, the stacker extending in an opposite direction to the second portion in the lateral direction, wherein the height adjustment unit is to adjust a height of the second portion from an installation surface, the height adjustment unit including:

a motor; and a gear assembly coupled to the motor to adjust the height of the second portion.

7. The finisher of claim 6, wherein the gear assembly includes:

a motor gear to be driven by the motor;

a worm roller and a worm wheel, the worm roller to be driven by the motor gear; and a rack gear and a pinion gear, the pinion gear to be driven by the worm wheel.

8. The finisher of claim 7, further comprising:

a frame column, wherein the rack gear is located on the frame column; and a frame base to receive the frame column, wherein the pinion gear is located within the frame base to couple with the rack gear.

9. The finisher of claim 8, wherein the frame column includes an idle roller and a moving roller, and wherein the frame base includes a channel to receive the idle roller and an inside wall to contact the moving roller.

10. The finisher of claim 6, further comprising:

a storage unit including height information of an image forming apparatus and instructions to control the motor; and a processor to:

obtain a current height of the second portion;

read the height information of the image forming apparatus from the storage unit; and execute the instructions to control the motor according to a difference between the height information of the image forming apparatus and the current height of the second portion.

11. A non-transitory computer-readable recording medium on which instructions for automatically controlling a height of a finisher is recorded, the non-transitory computer-readable recording medium comprising:

instructions to receive, from an image forming apparatus, identification information of the image forming apparatus;

instructions to obtain a docking height of the image forming apparatus;

instructions to obtain a height of a second portion of the finisher;

instructions to, if the height of the second portion is different from the docking height of the image forming apparatus, automatically change the height of the second portion and transmit docking instructions to the image forming apparatus; and instructions to, if the height of the second portion matches the docking height of the image forming apparatus, transmit the docking instructions to the image forming apparatus.

12. The non-transitory computer-readable recording medium of claim 11, wherein the instructions to transmit the docking instructions to the image forming apparatus include instructions to transmit a graphical user interface illustrating the docking of the finisher to the image forming apparatus.

13. The non-transitory computer-readable recording medium of claim 11, wherein the identification information of the image forming apparatus includes a model number, a serial number, a manufacturer, or the docking height of the image forming apparatus.

14. The non-transitory computer-readable recording medium of claim 11, wherein the instructions to obtain the docking height of the image forming apparatus comprise instructions to receive the docking height of the image forming apparatus from the image forming apparatus.

15. The non-transitory computer-readable recording medium of claim 11, wherein the instructions to obtain the docking height of the image forming apparatus comprise instructions to obtain the docking height of the image forming apparatus from a storage unit of the finisher based on the received identification information of the image forming apparatus.

* * * * *